US008529036B2

(12) United States Patent
Kodama et al.

(10) Patent No.: US 8,529,036 B2
(45) Date of Patent: Sep. 10, 2013

(54) LIQUID ACCOMMODATING CONTAINER AND LIQUID EJECTING APPARATUS

(75) Inventors: Hidetoshi Kodama, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/224,280

(22) Filed: Sep. 1, 2011

(65) Prior Publication Data

US 2012/0056956 A1 Mar. 8, 2012

(30) Foreign Application Priority Data

Sep. 3, 2010 (JP) ..... 2010-197328
Jun. 27, 2011 (JP) ..... 2011-141300

(51) Int. Cl.
*B41J 2/175* (2006.01)
*B41J 2/14* (2006.01)

(52) U.S. Cl.
USPC ..... 347/86; 347/50; 347/85

(58) Field of Classification Search
USPC ..... 347/50, 84, 85, 86
See application file for complete search history.

(56) References Cited

U.S. PATENT DOCUMENTS

| | | | |
|---|---|---|---|
| 6,488,369 | B1 | 12/2002 | Steinmetz et al. |
| 2003/0063158 | A1 | 4/2003 | Browning et al. |
| 2005/0185034 | A1 | 8/2005 | Anma et al. |

FOREIGN PATENT DOCUMENTS

| | | | |
|---|---|---|---|
| EP | 1 424 202 | A1 | 6/2004 |
| JP | 2006-142483 | A | 6/2006 |
| JP | 2007-230248 | A | 9/2007 |
| JP | 2010-023458 | A | 2/2010 |
| WO | 2009/143422 | A2 | 11/2009 |

*Primary Examiner* — Jannelle M Lebron
(74) *Attorney, Agent, or Firm* — Kilpatrick Townsend & Stockton LLP

(57) ABSTRACT

An improved liquid accommodating container that can be attached to or detached from a liquid ejecting apparatus while restricting undesired movement is provided herein. In an exemplary embodiment, the liquid accommodating container includes a container main body having a first wall that becomes a bottom surface when mounted, a second wall connected to the first wall, and a third wall connected to the first wall and faces the second wall; a liquid supply port; a terminal group having a plurality of terminals; and a first restriction portion provided in the second wall in a position closer to the first wall than the terminal group, which cooperates with a first apparatus side restriction portion of the liquid ejecting apparatus to restrict at least the movement of the liquid accommodating container in a width direction.

15 Claims, 18 Drawing Sheets

LIQUID ACCOMMODATING CONTAINER AND LIQUID EJECTING APPARATUS

This application claims priority to Japanese Patent Application No. 2010-197328, filed Sep. 3, 2010 and Japanese Patent Application No. 2011-141300, filed Jun. 27, 2011. Both of these applications are incorporated herein by reference in their entireties.

BACKGROUND

1. Technical Field

The present invention relates to a liquid accommodating container and a liquid ejecting apparatus including the liquid accommodating container.

2. Related Art

A printer as an example of a liquid ejecting apparatus discharges ink from a print head to a recording target (for example, printing paper) to perform the printing. As a technique of supplying ink to the print head, a technique of using an ink cartridge with ink accommodated therein is used (for example, JP-A-2010-23458). Specifically, by mounting an ink cartridge on a holder provided with the print head, it is possible to supply ink from the ink cartridge to the print head.

When ink in the ink cartridge becomes low, in order for a user to be able to exchange the ink cartridge, the ink cartridge is configured so as to be attachable to or detachable from a holder of the printer.

As disclosed in JP-A-2010-23458, in some cases, a circuit board having a terminal group electrically connected to the printer is attached to the ink cartridge. The circuit board has a storage portion that stores information on the ink cartridge (for example, ink color information) and transmits various information between the storage portion and the printer. The circuit board is attached to side surface different from a bottom surface provided with an ink supply port so that an erroneous operation due to the attachment of ink does not occur.

Furthermore, in order to accurately perform the positioning of the ink cartridge relative to the holder and satisfactorily perform the electrical connection between the terminal group and the printer, a concave portion to be engaged with a convex portion provided in the holder is provided on the bottom surface of the ink cartridge.

JP-A-2006-142483 and JP-A-2007-230248 are examples of the related art.

However, in the configuration in which the concave portion is provided on the bottom surface of the ink cartridge, in some cases, it is difficult to satisfactorily maintain the electrical connection between the terminal group and the printer. For example, when the holder with the ink cartridge mounted thereon is moved in a main scanning direction to perform the printing (such as when the printing is performed by an on-carriage type printer), in some cases, external force is applied to the ink cartridge by the movement of the holder or the like. Furthermore, for example, when the ink cartridge is mounted on the holder in a position different from the print head (such as when the printing is performed by an off-carriage type printer), in some cases, the vibration (the external force) is also applied to the ink cartridge by the movement of the print head or the like. As mentioned above, when the external force is applied to the ink cartridge, in some cases, a relative position between the ink cartridge and the holder may be misaligned and the electrical connection blocked. Such a problem is common to a liquid accommodating container placed on a liquid ejecting apparatus in an attachable and detachable manner that includes a terminal group to be electrically connected to the liquid ejecting apparatus, without being limited to the ink cartridge.

Furthermore, in a configuration in which the concave portion is provided on the bottom surface of the ink cartridge, there is a possibility that an outer edge (e.g. a wall) of the concave portion provided on the bottom surface of the ink cartridge might interfere with the convex portion of the holder depending on the insertion angle of the liquid accommodating container when inserted into the liquid ejecting apparatus. Such a problem is common to a technique which includes a mechanism that restricts the movement of the liquid accommodating container to be mounted on the liquid ejecting apparatus in an attachable and detachable manner, without being limited to the ink cartridge.

SUMMARY

Advantageously, in one aspect, the invention provides a technique that suppresses the relative movement between the terminal group of the liquid accommodating container and the holder on which the liquid accommodating container is mounted. In another aspect, the invention provides a technique that ensures a range of acceptable insertion angles of the liquid accommodating container when mounted on the liquid ejecting apparatus.

The invention can be realized in many forms and aspects, examples of which are described herein.

[Aspect 1] In this aspect, the invention includes a liquid accommodating container that can be attached to or detached from a liquid ejecting apparatus. The liquid accommodating container includes: a container main body that forms a liquid accommodation chamber for holding liquid in an inner portion thereof, the chamber having a liquid supply port for distributing liquid held within the liquid accommodation chamber toward the outside; a terminal group having a plurality of terminals configured so as to be electrically connected with the liquid ejecting apparatus; and a first restriction portion engageable with a first apparatus side restriction portion of the liquid ejecting apparatus so as to restrict at least movement of the liquid accommodating container in a width direction when engaged. In this aspect, main body has a first wall, at least a portion of which becomes a bottom surface in a mounting posture when mounted onto the liquid ejecting apparatus. The first wall is connected to each of a second and third wall such that at least a portion of the second wall faces a portion of the third wall. The liquid supply port is provided in the first wall closer to the third wall than the second wall. The terminal group is provided in or on the second wall so as to be electrically connected with the liquid ejecting apparatus. The first restriction portion is provided in or on the second wall closer to the first wall surface than the terminal group and cooperates with the first apparatus side restriction portion of the liquid ejecting apparatus to restrict movement of the liquid accommodating container in at least a width direction.

In the liquid accommodating container described in Aspect 1, the first restriction portion provided in the second wall surface is separated from the liquid supply port further than is the terminal group mounted on the third wall surface. Thus, as compared to a case where the first restriction portion is provided in the first wall surface that is the bottom surface, this aspect suppresses undesired movement of the second wall surface having the terminal group in the width direction.

[Aspect 2] In the liquid accommodating container described in Aspect 1, the first apparatus side restriction portion included in the liquid ejecting apparatus may be a protrusion shape, and the corresponding first restriction portion of the container may be a notch into which the protrusion shaped first apparatus side restriction portion can be inserted.

According to the liquid accommodating container described in Aspect 2, having a notch as the first restriction portion reduces the possibility of the first restriction portion interfering with the liquid ejecting apparatus when mounting the liquid accommodating container on the liquid ejecting apparatus. As a result, it is possible to reduce the likelihood of the liquid accommodating container or the liquid ejecting apparatus being damaged.

[Aspect 3] In the liquid accommodating container described in Aspect 2, the first restriction portion may open toward at least a first direction when the liquid accommodating container is mounted on the liquid ejecting apparatus, and a second direction perpendicular to the first direction, the second direction going from the third wall surface toward the second wall surface.

According to the liquid accommodating container described in Aspect 3, since the first restriction portion opens toward at least the first and second direction, it is possible to reduce the possibility of a wall defining the first restriction portion interfering with the first apparatus side restriction portion, as opposed to a case where the first restriction portion is opened only in the first direction. This aspect of the invention allows for additional degrees of freedom (e.g. an increased range of acceptable insertion angles) of the liquid accommodating container when mounting the liquid accommodating container on the liquid ejecting apparatus.

[Aspect 4] In the liquid accommodating container described in Aspect 2 or Aspect 3, the notch may be provided in the second wall surface so as to overlap with a part of the terminal group in the length direction, that is, the direction in which the second and third walls face each other.

According to the liquid accommodating container described in Aspect 4, since the notch comprising the first restriction portion overlaps with the terminal group in the length direction, this positional relationship between the first restriction portion and terminal group further suppresses the movement of the terminal group in the width direction relative to the liquid ejecting apparatus. In addition, in Aspect 4, the liquid accommodating container may further include a container side engagement portion that is provided in the second wall and is engageable with an apparatus side engagement portion included in the liquid ejecting apparatus so as to restrict movement of the liquid accommodating container in the height direction perpendicular to the first wall surface, and a protrusion portion that is provided on an outer surface of the third wall for inserting into a hole portion included in the liquid ejecting apparatus so as to restrict movement of the liquid accommodation container in the height and width direction. By including the container side engagement portion and the protrusion portion, the movement of the liquid accommodating container relative to the liquid ejecting apparatus can be further suppressed.

[Aspect 5] In the liquid accommodating container described in any one of Aspects 1 to 4, the plurality of terminals of the terminal group may be placed so as to form a plurality of rows of terminals. A first row of the plurality, which is in a position adjacent the first restriction portion, includes more terminals than a second row which is in a position further from the first restriction portion than the first row.

As the first restriction portion suppresses movement of the liquid accommodation container in the width direction, such movement is particularly restricted closest to the first restriction portion. According to the liquid accommodating container described in Aspect 5, since the first row of terminals is positioned closer to the first restriction portion than the second row, this configuration makes it possible to satisfactorily maintain the contact of the respective terminals of the first and second rows with the liquid ejecting apparatus.

[Aspect 6] In the liquid accommodating container described in Aspect 5, the plurality of rows including the first and second rows may include more terminals than the rows which are in the position closer to the first restriction portion.

According to the liquid accommodating container described in Aspect 6, since the movement of the width direction is suppressed close to the first restriction portion, many terminals are included in the row closest to the first restriction portion so as to maintain satisfactory contact of the respective terminals with the liquid ejecting apparatus.

[Aspect 7] In the liquid accommodating container described in any one Aspect 1 to 6, the liquid accommodating container may further include a prism situated in the first wall between the liquid supply port and the second wall, the prism extending from the first wall into the liquid accommodation chamber. The prism is used to optically detect an amount of the liquid of the liquid accommodation chamber by utilizing a reflection surface which can reflect an irradiation light irradiated from outside the liquid accommodation chamber toward an optical detection apparatus. Depending on the refractive index of fluid coming into contact with the reflection surface, the reflection state is changed so that when the level of the liquid within the accommodation chamber falls below the reflection surface (e.g. low or empty), the amount of liquid remaining within the chamber can be determined by the change in the reflection state sensed by the optical detection apparatus.

According to the liquid accommodating container described in Aspect 7, it is possible to detect the remaining quantity of liquid by the use of the prism. Furthermore, since the movement of the liquid accommodating container in the width direction is restricted by the first restriction portion provided in the second wall, the movement (deviation) of the prism relative to the liquid ejecting apparatus can be suppressed. Thus, the remaining quantity of liquid can be more accurately detected.

[Aspect 8] In the liquid accommodating container described in Aspect 7, the prism may be placed in contact with an inner surface of the second wall.

According to the liquid accommodating container described in Aspect 8, since the prism is provided in contact with the second wall having the first restriction portion, the movement (deviation) of the prism relative to the liquid ejecting apparatus in the width direction is further suppressed, as compared to a case where the prism is provided away from the second wall. Furthermore, positioning the prism in contact with the inner surface of the second wall reduces the possibility of liquid in the liquid accommodation chamber not being able to reach the liquid supply port due to interference by the prism. That is, according to the liquid accommodating container described in Aspect 7 and 8, it is possible to more accurately detect the remaining quantity of liquid by the use of the prism and further reduce the quantity of liquid retained in the liquid accommodation chamber.

[Aspect 9] In the liquid accommodating container described in Aspect 7, the liquid accommodating container may include two or more prisms, and a distance between the first wall and the reflection surface is sufficiently large so that the distance between the reflection surface and the optical detection apparatus is at least that of a length of the prism closest to the first restriction portion.

According to the liquid accommodating container described in Aspect 9, the state of the remaining quantity of liquid can be more specifically detected by using a plurality of prisms in which the distances between the first wall and the reflection surface of each prism are different. Furthermore, since the prisms are placed in a position close to the first restriction portion, to the extent the distance between the reflection surface and the optical detection apparatus is long, it is possible to reduce a difference in the detection accuracy of the remaining quantity of liquid using each prism.

[Aspect 10] In the liquid accommodating container described in any one of Aspect 7 to 9, a portion of the prism including the reflection surface may have a right angle isosceles triangular prism shape.

In general, by forming the reflection surface of the prism to have the right angle isosceles triangular shape, there is a tendency that, if the refractive indexes of fluid coming into contact with the reflection surface are different from each other, the reflection states of the irradiation light irradiated to the reflected surface are clearly different from each other. Thus, according to the liquid accommodating container described in Aspect 10, it is possible to further improve the detection accuracy of the remaining quantity of liquid using such prisms.

[Aspect 11] In the liquid accommodating container described in any one of Aspects 1 to 10, an inner surface of the second wall in the mounting posture may have an inclined surface that is tilted in a direction toward the liquid supply port as the inclined surface goes from an upper end to a lower end.

According to the liquid accommodating container described in Aspect 11, it is possible to cause liquid near the second wall to flow toward the liquid supply port with the inclined surface. As a result, it is possible to reduce the quantity of liquid retained in the liquid accommodation chamber.

[Aspect 12] A liquid ejecting apparatus including the liquid accommodating container described in any one of Aspects 1 to 12.

According to the liquid ejecting apparatus described in Aspect 12, it is possible to provide a liquid ejecting apparatus that reduces the possibility that the electrical connection between the terminal group and the liquid ejecting apparatus becomes blocked.

In addition, the invention can be realized in various forms and can be realized in the form of a manufacturing method of the liquid accommodating container or the like including any configuration mentioned above, in addition to the configuration as the liquid accommodating container and the liquid ejecting apparatus including the liquid accommodating container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the order as below.

A. First Embodiment:

B. Second Embodiment:

C. Modified Example:

A. FIRST EXAMPLE

A-1. Configuration of Liquid Ejecting Apparatus

Figure 1:
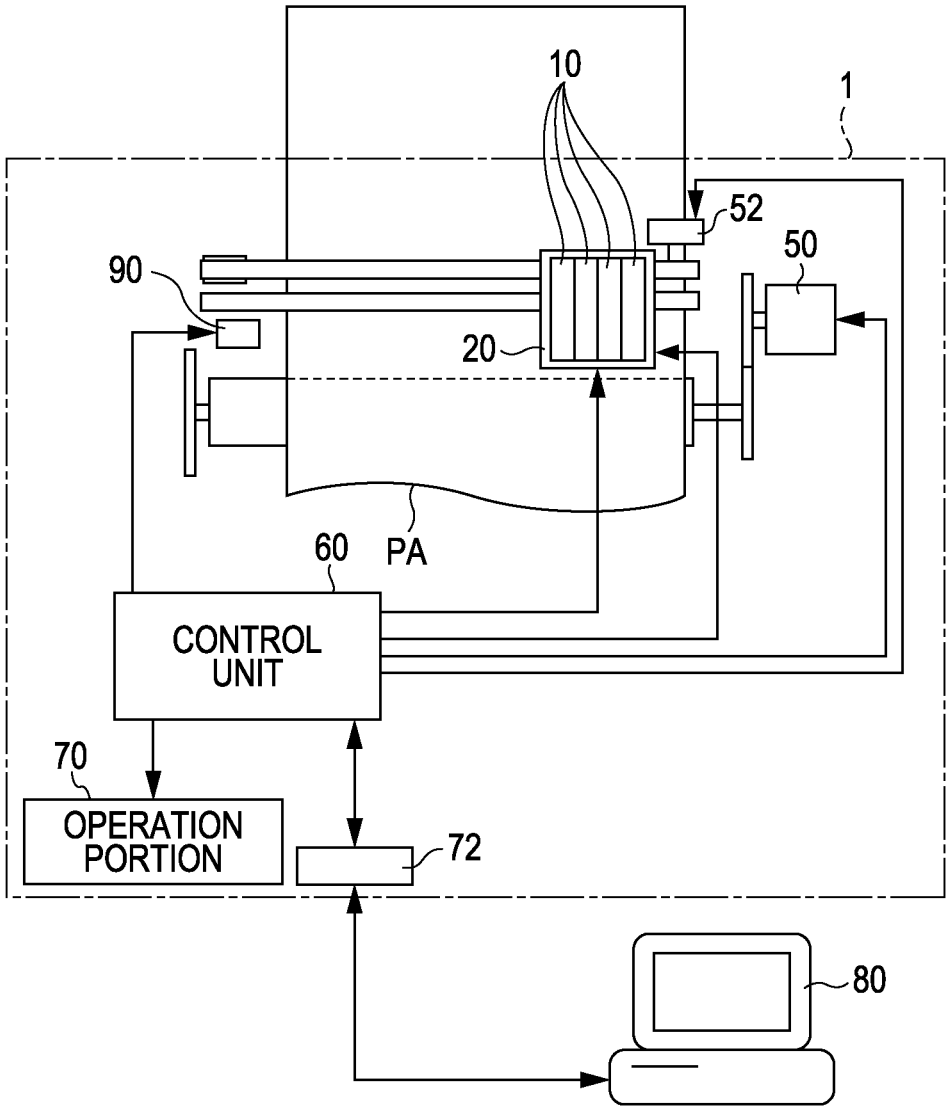
FIG. 1 is a diagram that shows a schematic configuration of a liquid ejecting apparatus.

FIG. 1 is a diagram that shows a schematic configuration of a liquid ejecting apparatus 1 including a plurality of liquid accommodating containers 10 and a holder 20 as a first embodiment of the invention. The liquid ejecting apparatus 1 is an ink jet printer 1 (hereinafter, simply referred to as "printer 1") that discharges ink to printing paper PA to perform printing. The printer 1 includes an ink cartridge 10 as a liquid accommodating container, a holder 20, a first motor 52, a second motor 50, a control unit 60, an operation portion 70, a predetermined interface 72, and an optical detection device 90. In addition, hereinafter, the ink cartridge 10 is simply referred to as "cartridge 10".

The holder 20 includes a print head (not shown) that discharges ink to a side facing the printing paper PA. Furthermore, the holder 20 has the cartridge 10 attachably and detachably mounted thereon. Each cartridge 10 is filled with an ink, such as cyan, magenta, and yellow inks Ink contained within the cartridge 10 is supplied to the print head of the holder 20 and the ink is discharged to the printing paper PA.

The first motor 52 drives the holder 20 in a main scanning direction. The second motor 50 transports the printing paper PA in a sub scanning direction. The control unit 60 controls an overall operation of the printer 1.

The optical detection device 90 is fixed in a predetermined position. When the holder 20 is moved to a predetermined position, the optical detection device 90 irradiates the cartridge 10 with light so as to detect the remaining quantity of ink.

The control unit 60 controls the first motor 52, the second motor 50 and the print head based on the print data received from a computer 80 or the like connected via a predetermined interface 72 to perform the printing. An operation portion 70 is connected to the control unit 60 and receives various operations from a user.

Figure 2:
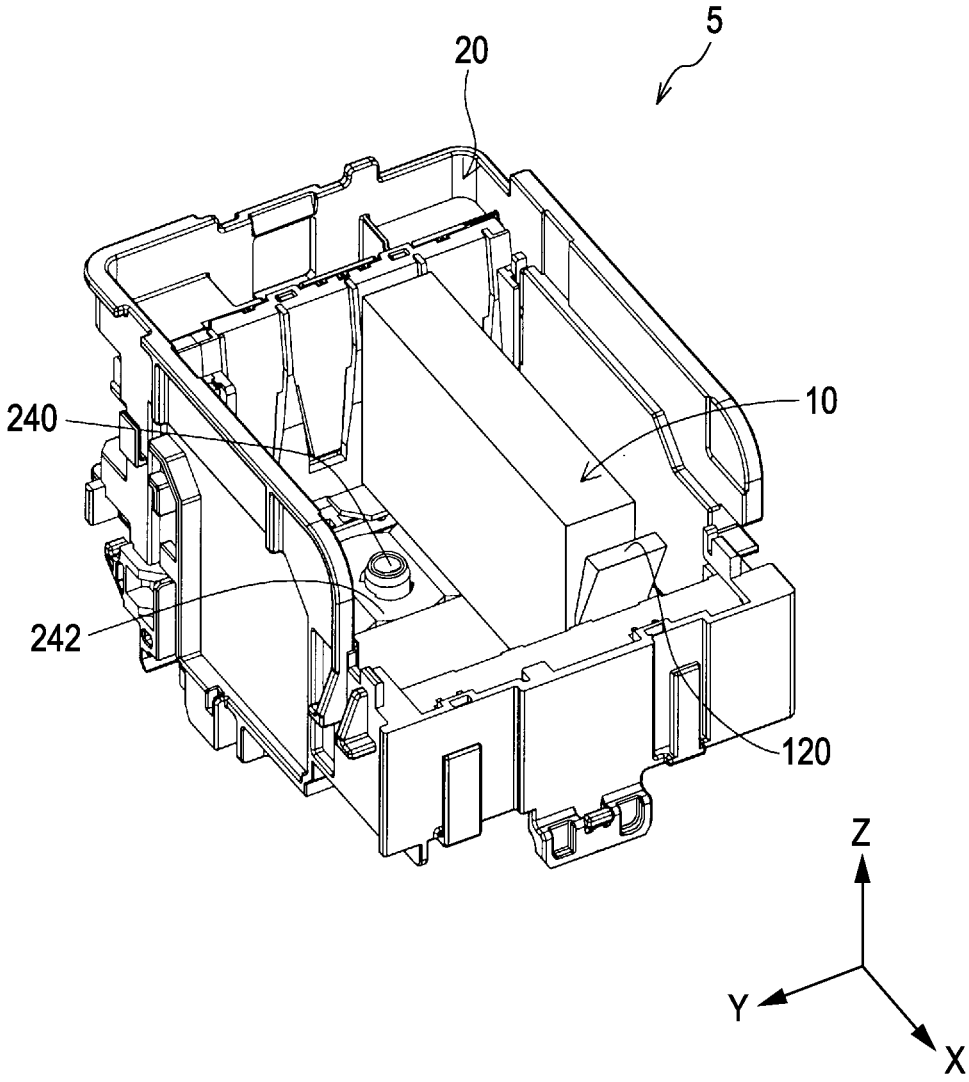
FIG. 2 is an exterior perspective view of an exemplary holder with cartridge mounted thereon.

FIG. 2 is an exterior perspective view of the holder 20 with the cartridge 10 mounted thereon. For ease of explanation, FIG. 2 shows an aspect in which one cartridge 10 is mounted on the holder 20. FIG. 2, as well as FIGS. 3-18B, shows an XYZ reference frame to specify directions, each of the XYZ axes perpendicular to each other.

The holder 20 has a configuration that can mount four cartridges 10. The holder 20 and the cartridge 10 constitute a unit 5. The number of cartridges 10 capable of being mounted on the holder 20 is not limited to four, and the configuration of the holder 20 may be changed depending on the number of the cartridges 10 required to be mounted. In a usage posture of the printer 1, a Z axis positive direction becomes a vertical upward direction, and a Z axis negative direction becomes a vertical downward direction, and the main scanning direction of the printer 1 becomes a Y axis direction. The usage posture of the printer 1 refers to a posture of the printer 1 in the state in which the printer 1 is installed on a horizontal plane. In the present embodiment, the horizontal plane is defined by the X axis and the Y axis. The posture (state), in which the cartridge 10 is mounted on the holder 20 in this usage posture, is referred to as a mounting posture (a mounting state).

The holder 20 has a liquid supply pipe 240 that allows for fluid communication between the cartridge 10 and the print head of the holder 20. Ink within the cartridge 10 is distributed to the print head via the liquid supply pipe 240. Furthermore, an elastic member 242 around the liquid supply pipe 240 is provided for preventing ink from leaking to the outside. The cartridge 10 has a lever 120 as an elastically deformed elastic portion (an attachment and detachment mechanism). A user can detach the cartridge 10 from the holder 20 by operating the elastic portion 120. The attachment or detachment operation of the cartridge 10 to the holder 20 will be described in further detail below.

A-2. Configuration of Cartridge

Figure 3B:
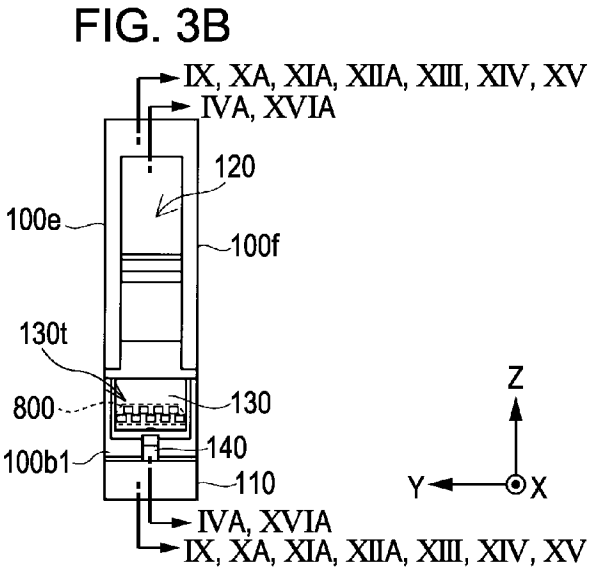
FIGS. 3A to 3D are side, front, rear and bottom views of an exemplary cartridge.
Figure 3D:
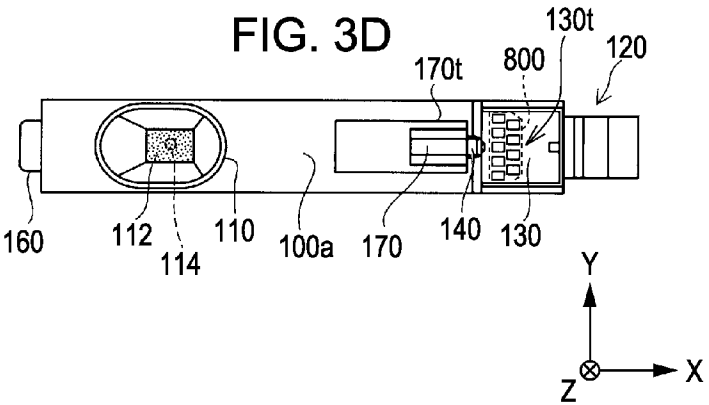
Figure 3A:
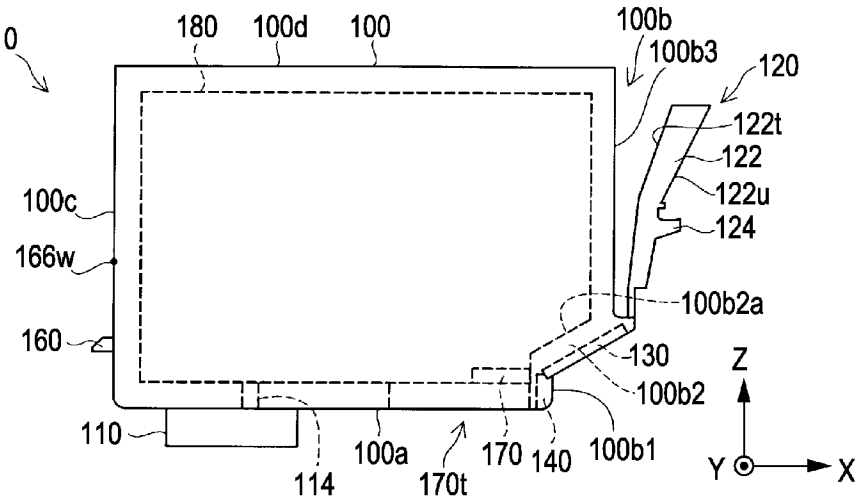
Figure 3C:
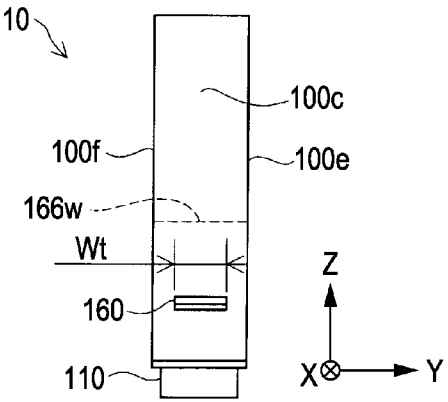
Figure 4A:
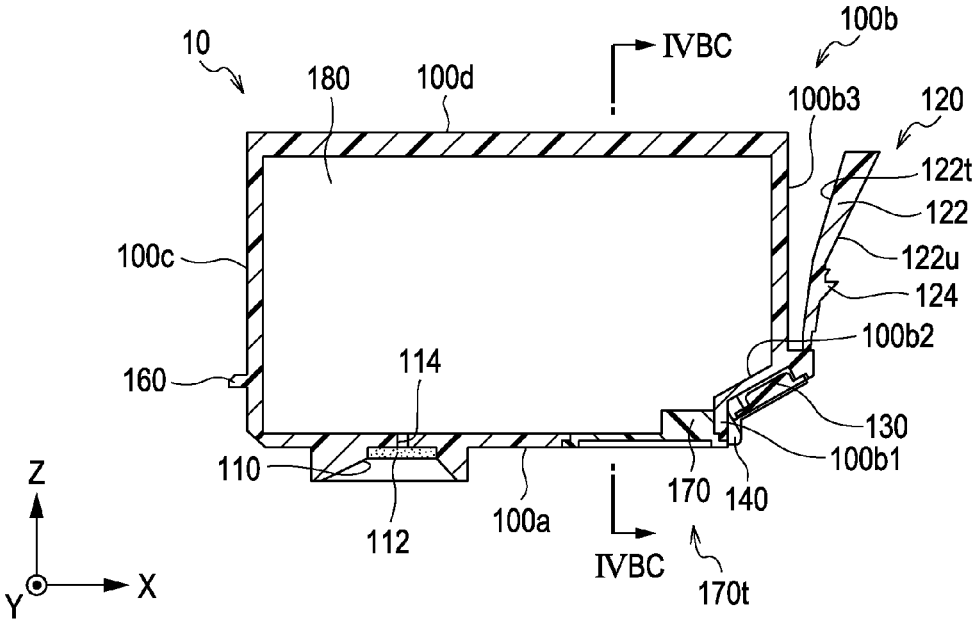
FIGS. 4A to 4C are cross-sections of an exemplary cartridge and prism.
Figure 4B:
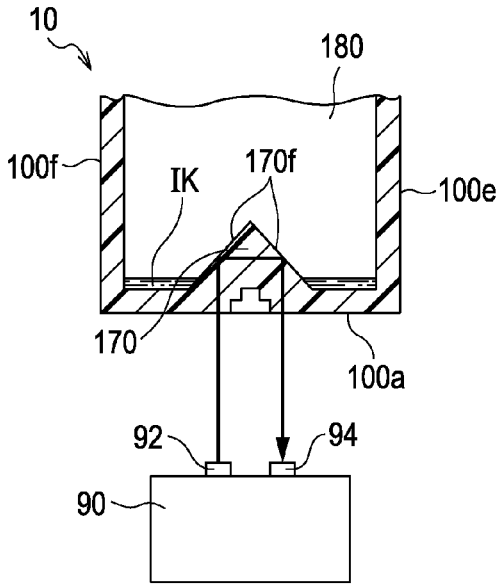
Figure 4C:
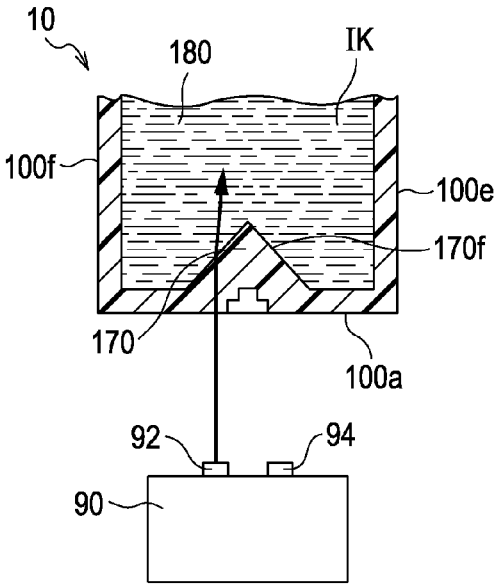

Next, a configuration of the cartridge 10 will be described using FIGS. 3A to 4C. FIGS. 3A to 3D are side, front, rear and bottom view elevations, respectively, depicting the cartridge 10. FIG. 3A is a side view of the cartridge 10. FIG. 3B is a front view of the cartridge 10. FIG. 3C is a rear view of the cartridge 10. FIG. 3D is a bottom view of the cartridge 10. FIGS. 4A to 4C are second diagrams for describing the cartridge 10. FIG. 4A is a cross-sectional view taken from lines IVA-IVA of FIG. 3B. FIGS. 4B and 4C are diagrams for describing a detection method of a remaining quantity of ink. FIGS. 4B and 4C show the cartridge 10 taken from lines IVBC-IVBC of FIG. 4A.

As shown in FIGS. 3A, 3B and 3D, the cartridge 10 includes a container main body 100, a lever 120, a liquid supply port 110, a circuit board 130, and a prism unit 170*t*. The container main body 100, the lever 120, and the liquid supply port 110 are formed of synthetic resin such as polypropylene.

As shown in FIGS. 3A to 3D, the container main body 100 has a first wall (also referred to as a "bottom surface") 100*a*, a second wall (also referred to as a "front surface") 100*b*, a third wall (also referred to as a "back surface") 100*c*, a fourth wall (also referred to as an "upper surface") 100*d*, a fifth wall (also referred to as a "left side surface") 100*e*, and a sixth wall (also referred to as a "right side surface") 100*f*. The container main body 100 has a liquid accommodation chamber 180 for accommodating ink in an inner portion formed by the first to sixth walls 100*a* to 100*f* (FIG. 3A).

The first wall 100*a* forms the side of the liquid accommodation chamber 180 facing downward (along the negative Z axis with respect to the liquid accommodation chamber 180). The second wall 100*b* faces in the direction of the positive X axis, the third wall 100*c* faces in the negative X axis direction, the fourth wall 100*d* faces in the positive Z axis positive direction side, the fifth wall 100*e* faces in the positive Y axis direction, and the sixth wall 100*f* is a wall of a Y axis negative direction side, each with respect to the liquid accommodation chamber 180. The height of the cartridge 10 extends in the direction of the Z axis, the length of cartridge 10 extends in the direction of the X axis, and the width extends in the direction of the Y axis. Herein, the concept is to use "the wall" having a predetermined thickness.

Both the inner surface and the outer surface of the first wall 100*a* constitute an approximately rectangular bottom surface in the mounting posture mounted on the holder 20. The fourth wall 100*d* faces the first wall 100*a*, and both the inner surface and the outer surface thereof constitute an approximately rectangular upper surface in the mounting posture. The outer surfaces of the first and fourth walls 100*a* and 100*d* become the horizontal surface in the mounting posture.

As shown in FIGS. 3A to 3D, the second, third, fifth and sixth walls 100*b*, 100*c*, 100*e*, and 100*f* are connected to each side (four sides) of the first and fifth walls 100*a* and 100*d*, respectively. In other words, the second, third, fifth and sixth walls 100*b*, 100*c*, 100*e*, and 100*f* are erected from the first wall 100*a*. Among them, the third, fifth, and sixth walls 100*c*, 100*e* and 100*f* perpendicularly intersect the first and fourth walls 100*a* and 100*d*. That is, the outer surfaces of each of the walls 100*c*, 100*e* and 100*f* have a vertical relationship with the horizontal surface in the mounting posture. The second wall 100*b* and the third wall 100*c* face each other, while the fifth wall 100*e* and the sixth wall 100*f* face each other.

As shown in FIG. 3A, the second wall 100*b* has a first vertical wall portion 100*b*1, an inclined wall portion 100*b*2, and a second vertical wall portion 100*b*3. In the mounting posture, the first vertical wall portion 100*b*1 is situated in the most vertical lower part of the portion of the second wall 100*b* and is erected vertically upward from the first wall 100*a*. The second vertical wall portion 100*b*3 is situated in the most vertical upper part of the portion of the second wall 100*b* and has a vertical relationship with the fourth wall 100*d*. The inclined wall portion 100*b*2 is connected to the first vertical wall portion 100*b*1 at one end portion and is connected to the second vertical wall portion 100*b*3 at the other end portion. The inclined wall portion 100*b*2 is tilted so as to cause ink near the second wall 100*b* of the liquid accommodation chamber 180 to flow toward the liquid supply port 110. That is, the inclined wall portion 100*b*2 has an inner surface 100*b*2*a* that is tilted in a direction approaching the liquid supply port 110 from the other end portion as the upper end toward one end portion as the lower end. In addition, the outer surface of the inclined wall portion 100*b*2 is also tilted similar to the inner surface 100*b*2*a*.

As shown in FIG. 3A, in the first wall 100*a*, a liquid supply port 110 is provided which causes ink of the liquid accommodation chamber 180 to flow toward the outside. The liquid supply port 110 is provided in a portion of the first wall 100*a* closer to the third wall 100*c* than the second wall 100*b*. Herein, the expression "the closer portion" can be evaluated by comparing the lengths from the respective outer surfaces of the second and third walls 100*b* and 100*c* to the liquid supply port in regard to the length direction (X axis direction) of the cartridge 10. The liquid supply port 110 communicates with a distribution flow path 114 formed in the first wall 100*a*, and distributes ink within the liquid accommodation chamber 180 toward the outside (in the present embodiment, the print head). As shown in FIGS. 3D and 4A, a sponge-like foam 112 is placed in the liquid supply port 110 to prevent ink from leaking out of the liquid supply port 110.

As shown in FIGS. 3A, 3D, and 4A, a prism unit 170*t* is placed in the first wall 100*a*, the prism unit 170*t* formed in a transparent shape from polypropylene. As shown in FIGS. 4A to 4C, the prism unit 170*t* has a prism 170 for use in detecting a quantity of ink remaining in the liquid accommodation chamber. The prism 170 has a right angle isosceles triangular prism shape and is placed so that a reflection surface 170*f* (FIGS. 4B and 4C) is situated in the liquid accommodation chamber 180. As shown in FIG. 4A, the prism 170 is placed in contact with the inner surface of the second wall 100*b* (specifically, the first vertical wall portion 100*b*1). By being placed in this manner, it is possible to prevent ink flow proceeding from the second wall 100*b* to the liquid supply port 110 from being restricted by the prism 170. As a result, the remaining quantity of ink retained in the liquid accommodation chamber 180 can be reduced as the chamber empties during use, thereby increasing efficiency of ink consumption.

The prism 170 differs in the reflection state of light depending on the refractive index of fluid coming into contact with the reflection surface 170*f*. As shown in FIG. 4B, when the remaining quantity of ink is reduced to the extent that the reflection surface 170*f* comes into contact with air, due to the difference between the refractive indexes between the prism 170 and air, light irradiated from the light emitting element 92 is reflected by the reflection surface 170*f* of the prism 170 and is incident to a light sensing element 94. Meanwhile, as shown in FIG. 4C, when ink is present within the liquid accommodation chamber 180 to the extent that the reflection surface 10*f* comes into contact with ink IK, since the refractive index of the prism 170 is about the same as that of ink, as shown in FIG. 4C, light irradiated from the light emitting element 92 is slight refracted by the reflection surface 170*f* and proceeds to ink IK. That is, by detecting light that is incident to the light sensing element 94, the remaining quantity of ink can be detected.

Furthermore, as shown in FIGS. 3A, 3B and 4A, a notch (groove) 140 is provided in the first vertical wall portion 100*b*1 of the second wall 100*b*. The notch 140 is provided in a position closer to the first wall 100*a* than the terminal group 130*t*. Specifically, in regard to the height direction (Z axis direction), the notch 140 is provided in a position closer to the first wall 100*a* along the Z axis direction than is the terminal group 130*t*. In the present embodiment, the notch 140 is provided in a portion that becomes a bottom or lower portion of the second wall 100*b* in the mounting posture. Furthermore, as shown in FIG. 3B, the notch 140 is provided in the approximate center of the width direction of the first vertical wall portion 100*b*1. As mentioned above, the notch 140 is provided in the corner portion of the first wall 100*a* side of the second wall 100*b*. Specifically, the notch 140 is formed is formed over two surfaces of the bottom surface and the side surface (the external surface) in the corner portion of the first wall 100*a* side of the second wall 100*b*. That is, the notch 140 is formed in the shape of a groove (a concave shape) on the outer surface of the second wall 100*b* in the corner portion of the first wall 100*a* side of the second wall 100*b*. More specifically, notch 140 opens toward at least the two directions of the Z axis negative direction (the first direction) and the X axis positive direction (the second direction) perpendicular to the Z axis negative direction. Herein, the Z axis negative direction is an advancement direction of the cartridge 10 upon mounting the cartridge 10 on the holder 20 that is a component of the printer 1, and the X axis positive direction is a direction perpendicular to the advancement direction. In other words, the X axis positive direction is a direction that goes from the third wall 100*c* toward the second wall 100*b*. The notch 140 at least includes an opening that opens in the direction of the negative Z axis) and is formed so as to receive the first apparatus side restriction portion 270 in the erected state, and opens in the direction of the positive X axis and is formed on the outer surface of the second wall 100*b*. Furthermore, the notch 140 includes a wall constituted by the second wall 100*b* on both sides in the width direction (along the Y axis) of the cartridge 10.

As shown in FIGS. 3A and 4A, the circuit board 130 including the terminal group 130*t* (described in more detail below) is provided in the inclined wall portion 100*b*2 of the second wall 100*b*. As shown in FIG. 3A, in regard to the length direction (the X axis direction) the notch 140 is provided so as to partially overlap with the circuit board 130. That is, in the mounting state (the mounting posture) in which the cartridge 10 is mounted on the holder 20, the circuit board 130 is situated vertically upward the notch 140. When the cartridge 10 is vertically projected in the vertical direction (along the Z axis), the notch 140 is provided so as to partially overlap with the circuit board 130. In addition, regarding the length (in the X axis direction), it is desirable that the notch 140 be provided so as to overlap with a part of the terminal group 130*t* included in the circuit board 130. Herein, the expression "the notch 140 overlaps with a part of the terminal group 130*t* included in the circuit board 130" means that "a containment region 800 surrounded by a minimum polygon (specifically, a convex polygon having the magnitude of all the inner angles less than 180°) including the terminal group 130*t* partially overlaps with the notch 140. The circuit board 130 is electrically connected to the control unit 60 (FIG. 1) of the printer 1 upon being mounted on the holder 20, whereby various information (signals) is transmitted between the circuit board 130 and the printer 1. In addition, the details of the circuit board 130 will be described further below.

As shown in FIGS. 3A and 4A, the lever 120 is provided in the second wall 100*b*. Specifically, the lower end surface of the lever 120 is attached to the inclined wall portion 100*b*2. Lever 120, which extends upward from the lower end surface, has elasticity and is elastically deformed in the length direction (the X axis direction) by external force. The lever 120 has a container side engagement portion 124 and an engagement release portion 122. The container side engagement portion 124 is engaged with the holder 20 to restrict the movement the height direction of the cartridge 10. Specifically, the container side engagement portion 124 restricts the movement of the height direction of the second wall 100*b* side. The engagement release portion 122 is a portion to which external force is applied by a user, and is used to release the engagement between the holder 20 and the container side engagement portion 124. The engagement release portion 122 has a first side surface 122*t* facing the second wall 100*b*, and a second side surface 122*u* opposite the first side surface 122*t*. When the first side surface 122*t* comes into contact with the second wall 100*b*, the second side surface 122*u* is tilted so as to approach a rotation fulcrum 166*w* described later as the second side surface 122*u* goes from the upper end to the lower end. The inclination of the second side surface 122*u* of such direction is also called a "downward inclination" below.

As shown in FIGS. 3A, 3C and 4A, among the portions of the third wall 100*c*, in a portion occupying the height equal to or less than half in the height direction, a protrusion portion 160 is provided. The protrusion portion 160 is used so as to restrict the movement of the cartridge 10 after the cartridge 10 is mounted on the holder 20. Specifically, the protrusion portion 160, which has a width Wt (FIG. 3C), restricts the movement of the width direction and the height direction of the third wall 100*c* side of the cartridge 10 when mounted.

Furthermore, as shown in FIGS. 3A and 3C, the third wall 100*c* has a rotation fulcrum 166*w* which comes into contact with the holder 20 and becomes a fulcrum of rotation upon detaching the cartridge 10 from the holder 20 by the rotation operation. The rotation fulcrum 166*w* is situated below the engagement point at which the container side engagement portion 124 is engaged with the holder 20 in regard to the height direction. In other words, the rotation fulcrum 166*w* is situated below the engagement release portion 122 in regard to the height direction. Furthermore, in the third wall 100*c*, an atmosphere opening hole (not shown) for introducing air therein according to the consumption of ink of the liquid accommodation chamber 180 is formed.

Figure 5A:
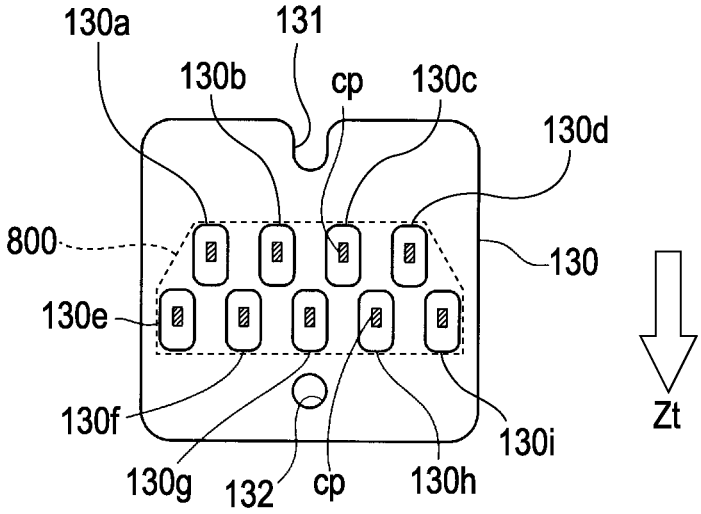
FIGS. 5A and 5B are front and side views of an exemplary terminal group.
Figure 5B:
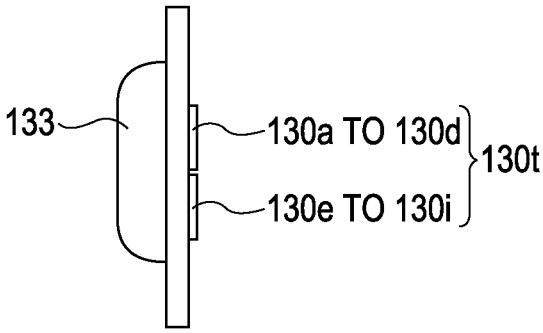

FIGS. 5A and 5B are diagrams for describing the circuit board 130. FIG. 5A shows a configuration of the surface of the circuit board 130. FIG. 5B shows a diagram in which the circuit board 130 is viewed from the side. The surface of the circuit board 130 is a surface that is exposed to the outside upon being attached to the cartridge 10. In addition, an arrow Zt indicates an insertion direction of the cartridge 10 to the holder 20.

As shown in FIG. 5A, a boss groove 131 is formed in the upper end portion of the circuit board 130, and a boss hole 132 is formed in the lower end portion of the circuit board 130. The boss groove 131 and the boss hole 132 are used so as to attach the circuit board 130 to the container main body 100.

The circuit board 130 includes a terminal group 130*t* including nine terminals 130*a* to 130*i* placed on the surface, and a storage portion 133. The storage portion 133 placed on the rear surface houses information (e.g., the remaining quantity of ink or the ink color) regarding contained within the cartridge 10. The terminals 130*a* to 130*i* are formed in an approximately rectangular shape and are placed so as to form two rows approximately perpendicular to the insertion direction Zt. Of the two rows, the row situated inside the insertion direction Zt, the underside in FIG. 5A, is called a lower side row (a first row), and the row situated at the front side of the insertion direction Zt, upside in FIG. 5A, is called an upper row (a second row). As mentioned above, the exterior of the containment region 800 surrounded by the minimum convex polygon including the terminal group 130*t* is shown by dashed lines. In the present embodiment, the containment region 800 is a hexagon.

In the central portions of each terminals 130*a* to 130*i*, a contact portion cp is included which comes into contact with the corresponding terminals among the apparatus side terminals attached to the holder 20. The respective contact portions cp of the terminals 130*a* to 130*d* forming the upper row and the respective contact portions cp of the terminals 130*e* to 130*i* forming the lower row are staggered, and constitute a so-called zigzag shape arrangement. The terminals 130*a* to 130*d* forming the upper row and the terminals 130*e* to 130*i* are also staggered so that the mutual terminal center is not aligned in the insertion direction Zt, and to constitute an arrangement of the zigzag shape. The circuit board 130 is attached to the cartridge 10 so as to have the row having the most terminals closest to the notch 140 of the cartridge 10. That is, the circuit board 130 is attached to the cartridge 10 so that the lower row (the first row) becomes the lower position than the upper row (the second row) in the height direction of cartridge 10.

The terminals 130*a* to 130*d* forming the upper row and the terminals 130*e* to 130*i* forming the lower row have the following functions (applications) as described below.

Upper Row
(1) Mounting Detection Terminal 130*a*
(2) Reset Terminal 130*b*
(3) Clock Terminal 130*c*
(4) Mounting Detection Terminal 130*d*
Lower Row
(5) Mounting Detection Terminal 130*e*
(6) Power Source Terminal 130*f*
(7) Ground Terminal 130*g*
(8) Data Terminal 130*h*
(9) Mounting Detection Terminal 130*i*

Four mounting detection terminals 130*a*, 130*d*, 130*e*, and 130*i* are used so as to detect the quality of the electrical connection between the detection terminals and the apparatus side terminals and are able to be referred to as "contact detection terminals." The other five terminals 130*b*, 130*c*, 130*f*, 130*g*, and 130*h* are terminals for the storage portion 133.

A-3. Holder Configuration

Figure 6A:
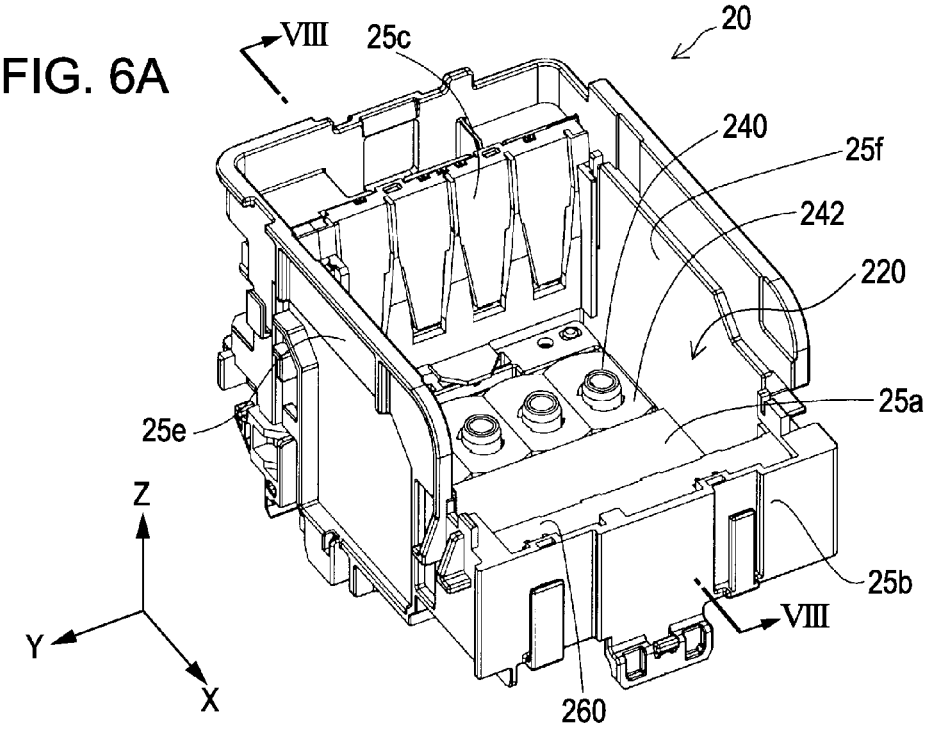
FIGS. 6A and 6B are exterior perspective views of an exemplary holder.
Figure 6B:
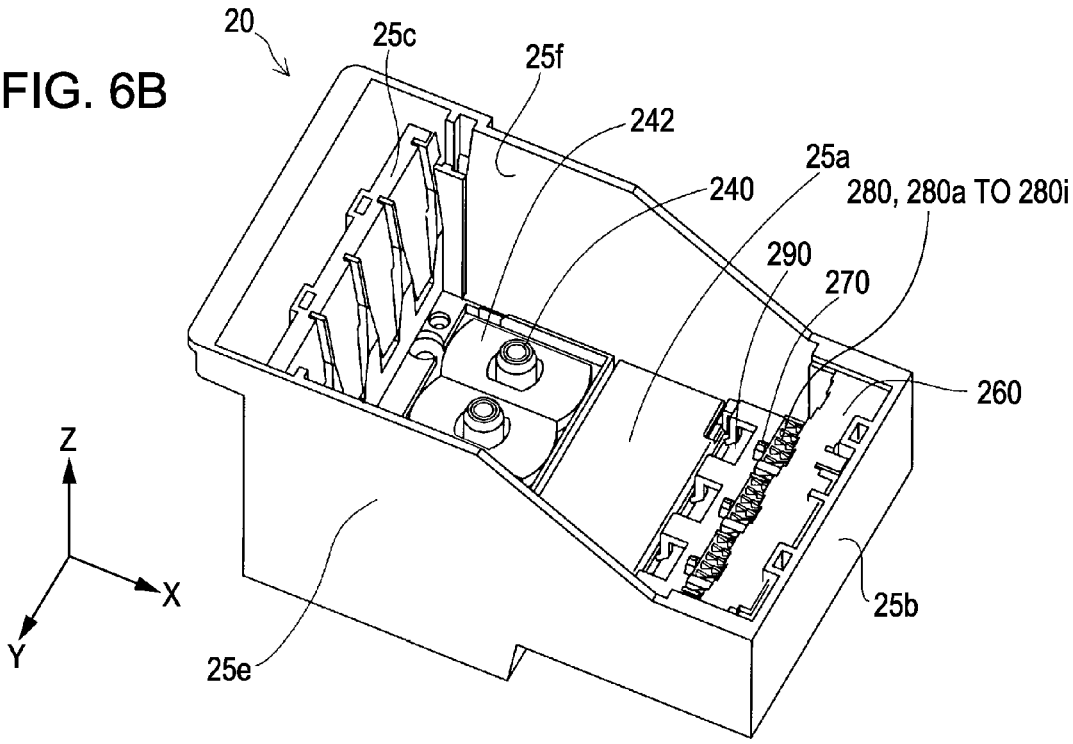
Figure 7A:
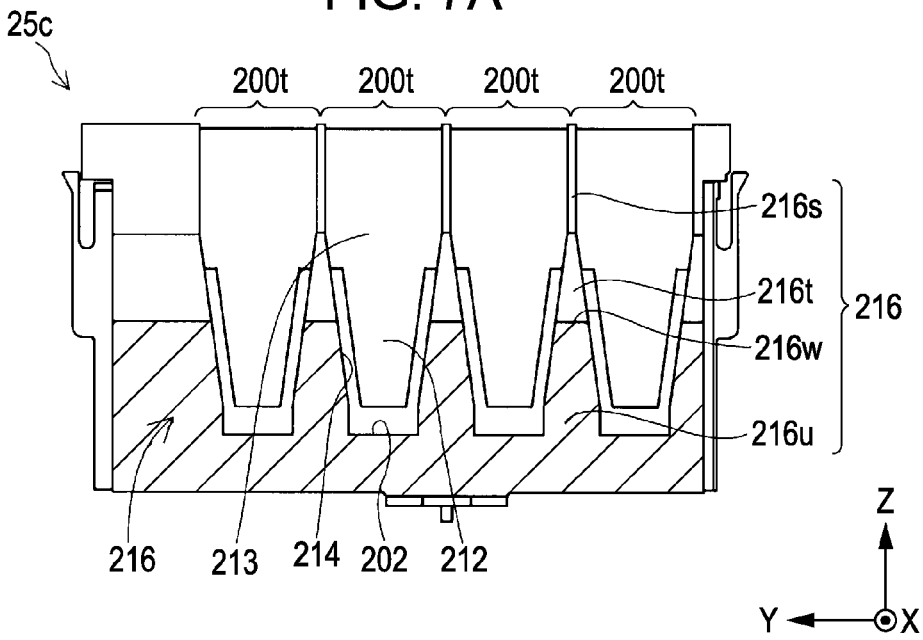
FIGS. 7A and 7B depict detailed configurations of an exemplary apparatus.
Figure 7B:
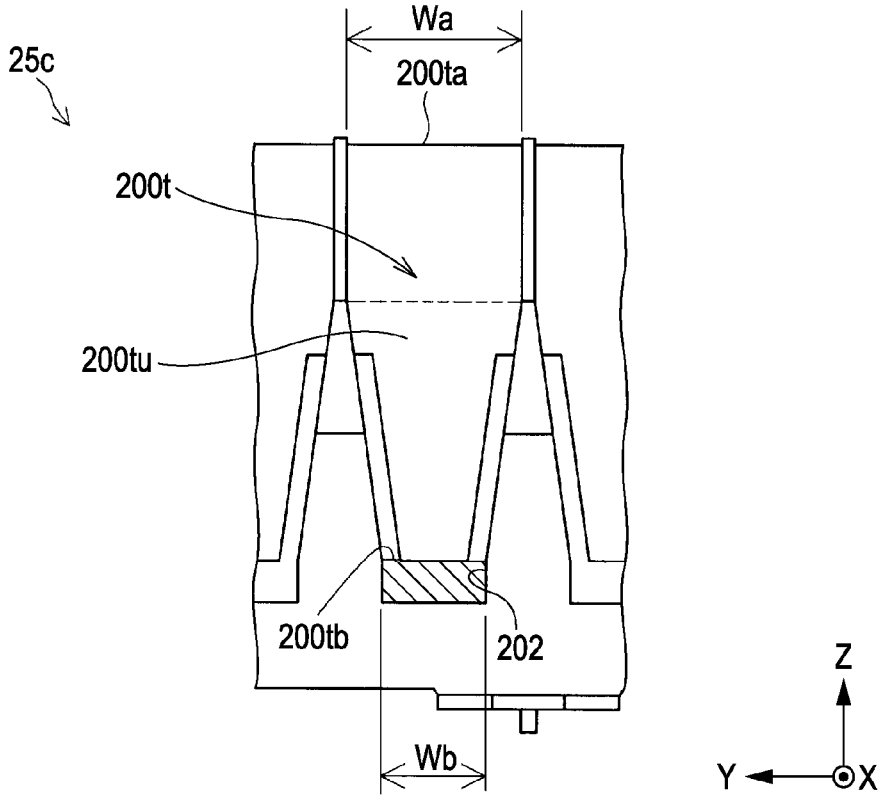
Figure 8:
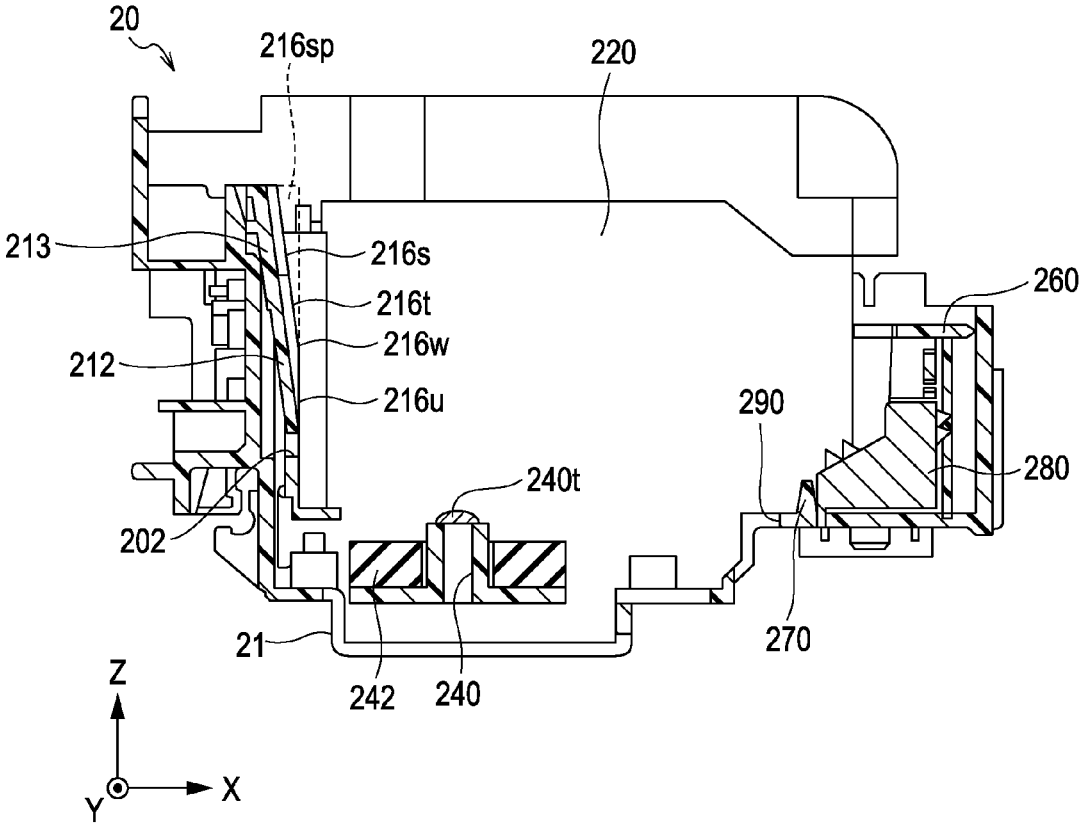
FIG. 8 is a cross-sectional view taken from lines VIII-VIII of FIG. 6A.

A detailed configuration of the holder 20 is described using FIGS. 6A to 8. FIGS. 6A and 6B show details of the holder 20. FIG. 6A is a first exterior perspective view of the holder 20, and FIG. 6B is a second exterior perspective view of the holder 20. In the second exterior perspective view, a part of an outer peripheral wall forming the holder 20 is omitted for ease of explanation. FIGS. 7A and 7B are diagrams for describing a detailed configuration of an apparatus side opposed wall 25*c*. FIG. 7A is a diagram in which the apparatus side opposed wall 25*c* is viewed from the X axis positive direction side. FIG. 7B is a partially enlarged view of FIG. 7A. FIG. 8 is a cross-sectional view taken from lines VIII-VIII of FIG. 6A. In the cross-sectional view of FIG. 8, the vicinity of the liquid supply pipe 240 is simplified for ease of explanation.

As shown in FIGS. 6A, the holder 20 has a concave shape in which a portion is opened so as to permit the cartridge 10 to be attached or detached. The holder 20 has an apparatus side bottom wall (also referred to as a "bottom surface") 25*a*, an apparatus side wall ("the front") 25*b*, an apparatus side opposed wall (also referred to as a "back") 25*c*, a first apparatus side wall (also referred to as a "left side") 25*e*, and a second apparatus side wall (also referred to as a "right side") 25*f*. A cartridge accommodation chamber 220 as a container accommodation portion accommodating the cartridge 10 is formed by the walls 25*a*, 25*b*, 25*c*, 25*e*, and 25*f*. The respective walls 25*a*, 25*b*, 25*c*, 25*e*, and 25*f* are formed of synthetic resin such as polypropylene.

The apparatus side bottom wall 25*a* constitutes the bottom surface in the usage posture of the printer 1. The apparatus side opposed wall 25*c*, the apparatus side engagement wall 25*b*, the first apparatus side wall 25*e*, and the second apparatus side wall 25*f* are erected from the apparatus side bottom wall 25*a*. The apparatus side opposed wall 25*c* and the apparatus side engagement wall 25*b* have an opposing relationship, and the first apparatus side wall 25*e* and the second apparatus side wall 25*f* have an opposing relationship.

A liquid supply pipe 240 and a seal member 242 are attached to the apparatus side bottom wall 25*a*, and an end side of the liquid supply pipe 240 is connected to a print head 21 (FIG. 8) that is attached to the rear surface (the surface in the negative Z axis direction) of the apparatus side bottom wall 25*a*. Furthermore, when the cartridge 10 is mounted on the holder 20, the other end side of the liquid supply pipe 240 is connected to the liquid supply port 110 (FIG. 3A) of the cartridge 10. The seal member 242 is a member having elasticity such as synthetic rubber. The seal member 242 is placed around the liquid supply pipe 240, and prevents ink from leaking to the outside when the cartridge 10 is mounted on the holder 20. Furthermore, as shown in FIG. 8, on the other side of the liquid supply pipe 240, a porous metallic filter 240*t* is provided which partially comes into contact with the foam 112 (FIG. 4A) within the liquid supply port 110. For the filter 240*t*, a stainless mesh or a stainless nonwoven fabric can be used. Optionally, the filter 240*t* can be omitted.

As shown in FIG. 6B, in the apparatus side bottom wall 25*a*, four through holes 290 (only three of them are shown in FIG. 6B) and four first apparatus side restriction portions 270 (only three of them are shown in FIG. 6B) are provided corresponding to the number (four) of cartridges 10 to be mounted. In the apparatus side bottom wall 25*a*, four contact mechanisms 280 (only three of them are shown in FIG. 6B), are positioned so as to correspond to the number of the cartridge 10 to be mounted.

The through hole 290 is used in the detection of the remaining quantity of ink within the cartridge 10 using the optical detection device 90 provided on the Z axis negative direction side of the holder 20. Specifically, the through hole 290 allows for passage of light emitted from the optical detection device 90 to therethrough as well as light reflected from the cartridge 10.

Typically, the shape of the first apparatus side restriction portion 270 is a protrusion shape, and the first apparatus side restriction portion 270 has a pointed shape as it goes upward. The first apparatus side restriction portion 270 of the cartridge 10 is inserted within the notch 140 so as to restrict movement of the cartridge 10 in the width direction (the Y axis direction). In addition, the first apparatus side restriction portion 270 is also called a restriction pin 270. The restriction pin 270 may be integrally formed with the holder 20 as in the present embodiment and may be attached to the apparatus side bottom 25*a* as a separate member.

The contact mechanism 280 is used for electrically connecting the circuit board 130 of the cartridge 10 with the control unit 60 of the printer 1. The contact mechanism 280 has a plurality of electric contact members (also called "terminals") 280*a* to 280*i* for electrically connecting with the terminals 130*a* to 130*i* of the circuit board 130. Typically, the number of the electric contact members 280*a* to 280*i* corresponds to the number of the terminals 130*a* to 130*i* (FIG. 5A) of the circuit board 130 and is nine in the present embodiment, the contact mechanism 280 being electrically connected to the control unit 60.

The apparatus side engagement wall 25*b* has an apparatus side engagement portion 260 that is horizontally extended in the usage posture of the printer 1. The apparatus side engagement portion 260 has a flat plate shape and is held in a predetermined height position from the apparatus side bottom wall 25*a*. The apparatus side engagement portion 260 is engaged with the container side engagement portion 124 (FIG. 3A) of the cartridge 10 and restricts the movement of the cartridge 10 in the height direction after the cartridge 10 is mounted.

As shown in FIG. 7A, the apparatus side opposed wall 25*c* includes an upright wall surface 216, a guide groove 200*t*, and a hole portion 202 formed in the upright wall portion 216. In the usage posture, the upright wall portion 216 is extended upward (the Z axis positive direction) from the apparatus side bottom wall 25*a*. The upright wall portion 216 has an opposed surface 216*u*, an extension surface 216*t* and an upper surface 216*s* from the lower part in order. In the usage posture, the opposed surface 216*u* is extended vertically upward from the apparatus side bottom wall 25*a*. In other words, the opposed surface 216*u* forms a surface that is approximately parallel to the outer surface of the third wall 100*c* (FIG. 3A) of the cartridge 10 in the mounting state in which the cartridge 10 is mounted on the holder 20. In order to facilitate understanding, the opposed surface 216*u* is illustrated with a single line hatching.

The extension surface 216*t* is extended from the upper end of the opposed surface 216*u* toward the outside (exterior) of the holder 20. In other words, in the mounting state, the extension surface 216*t* is extended in a direction away from the outer surface of the third wall 100*c* (FIG. 3A) of the cartridge 10. In the present embodiment, the extension surface 216*t* constitutes an inclined surface that is tilted with respect to the vertical direction. Furthermore, the apparatus side opposed wall 25*c* has a rotation fulcrum 216*w* corresponding to the rotation fulcrum 166*w* of the cartridge 10. The rotation fulcrum 216*w* is defined by the boundary between the opposed surface 216*u* and the extension surface 216*t*. The rotation fulcrum 216*w* is also called an upper end of the opposed surface 216*u*.

The upper surface 216*s* is extended upward from the lower end of the extension surface 216*t* in the usage posture of the printer 1. Similar to the extension surface 216*t*, the upper surface 216*s* is inclined with respect to the vertical direction.

As shown in FIG. 8, by forming the opposed surface 216*u*, the extension surface 216*t* and the upper surface 216*s*, a space portion 216*sp* is formed which can receive a part of the cartridge 10 when separating the cartridge 10 while being rotated.

In regard to FIGS. 7A and 7B, the protrusion portion 160 (FIG. 3A) of the cartridge 10 is inserted into the approximately rectangular hole portion 202. As a result, the movement of the cartridge 10 in the width direction (the Y axis direction) and the height direction (the Z axis direction) in the mounting state is restricted within a predetermined range. In addition, the width Wb of the hole portion 202 is approximately the same as the width Wt of the protrusion portion 160 of the cartridge 10. Since the attachment or detachment operation of the cartridge 10 to or from the holder 20 is performed by the rotation operation described later, a gap of the height direction between the hole portion 202 of the holder 20 and the protrusion portion 160 (FIG. 3C) of the cartridge 10 in the mounting state is greater than the gap of the width direction.

The guide groove 200*t* guides the protrusion portion 160 to the hole portion 202 while restricting the movement of the cartridge 10 in the width direction when the cartridge 10 is mounted on the holder 20. As shown in FIG. 7B, the guide groove 200*t* is formed over the hole portion 202 from the upper end of the apparatus side opposed wall 25*c*. In addition, in order to facilitate understanding, in FIG. 7B, the hole portion 202 is illustrated with single line hatching. By providing the guide groove 200*t*, since there is no need to provide another member for positioning the cartridge 10 (e.g., a partition wall) in the holder 20, the holder 20 can be reduced in size. In addition, the upper end of the guide groove 200*t* does not need to be situated in the upper end of the apparatus side opposed wall 25*c* but may be situated in the middle portion of the apparatus side opposed wall 25*c* in the height direction.

The width Wa of the upper end 200*ta* of the guide groove 200*t* is greater than the width Wb of the lower end 200*tb*. The lower end 200*tb* has the same width as that of the hole portion 202, and the width Wa of the upper end 200*ta* is greater than the width Wt (FIG. 3C) of the protrusion portion 160 of the cartridge 10. Furthermore, the width of the guide groove 200*t* is monotonically reduced as it approaches from the upper end 200*ta* to the lower end 200*tb* (that is, the hole portion 202). Herein, the expression "monotonically reduced" may include the portion of the constant width if a portion having the increased width is not included as approaching from the upper end 200*ta* to the lower end 200*tb*. More specifically, the guide groove 200*t* has a tapered lower guide groove 200*tu* in which the width is gradually reduced as it approaches the hole portion 202. In addition, the boundary between the lower guide groove 200*tu* and other portions is added with dashed lines.

As shown in FIGS. 7A and 8, the apparatus side opposed wall 25*c* has a deformation portion 212 that can be elastically deformed in the depth direction (the X axis direction, a direction in which the apparatus side engagement portion 260 and the apparatus side opposed wall 25*c* face each other) of the guide groove 200*t*. In other words, the deformation portion 212 is configured so as to be elastically deformable toward the outside (the exterior, the X axis negative direction) of the cartridge accommodation chamber 220 to receive cartridge 10. The deformation portion 212 is formed by applying the notch 214 at both ends (both sides) of the groove bottom wall 213 constituting the bottom surface of the guide groove 200*t*. The notch 214 passes through the groove bottom wall 213. The deformation portion 212 is extended from the portion coming into contact with the hole portion 202 of the portions of the groove bottom wall 213 to a height equal to or greater than a predetermined height. The predetermined height indicates a portion that is situated in a position higher than an intersection point in which rotation trace of the protrusion portion 160 (FIG. 4A) in the case of mounting the cartridge 10 by a predetermined method intersects the groove bottom wall 213.

A-4. Attachment of Cartridge

Figure 9A:
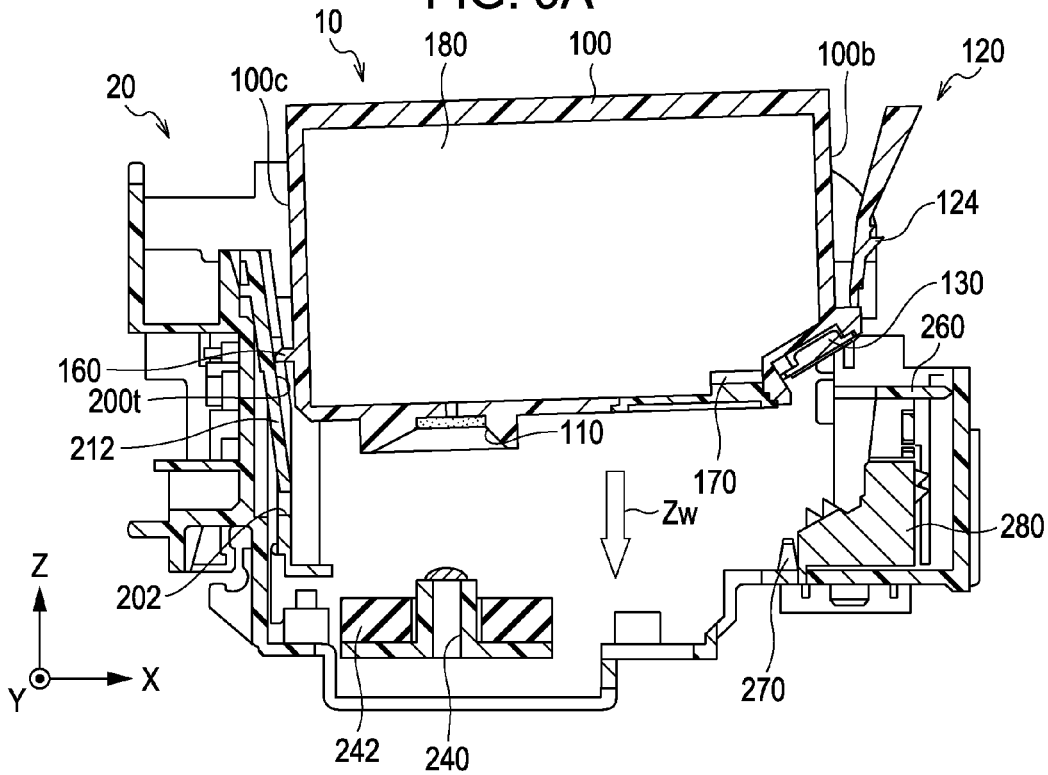
FIGS. 9A and 9B are cross-sectional side views before and after attaching an exemplary cartridge.
Figure 9B:
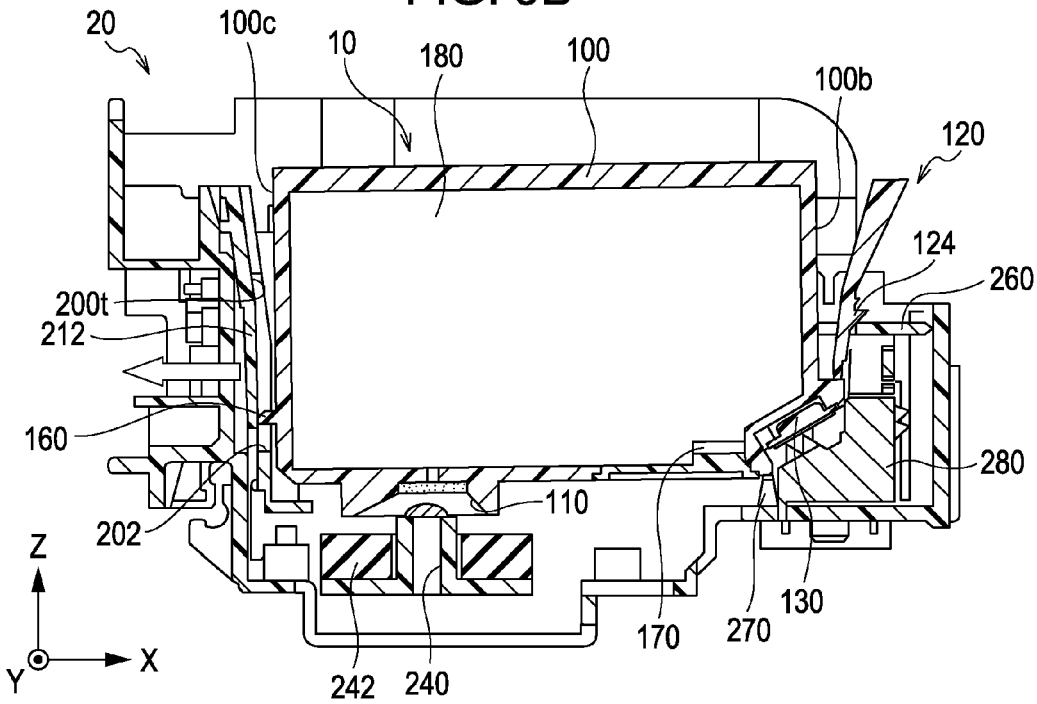

FIGS. 9A and 9B illustrate attachment of the cartridge 10 to holder 20, before and after attachment, respectively. FIGS. 9A and 9B are side views of cross-section IX-IX of the cartridge 10 of FIG. 3B and of the holder 20 corresponding to the cross-section IX-IX. A mounting method (a normal mounting method) commonly adopted when a user mounts the cartridge 10 on the holder 20 will be described in further detail below.

As shown in FIG. 9A, in the normal mounting method, the cartridge 10 is tilted so that the protrusion portion 160 of the third wall 100*c* comes into contact with the apparatus side opposed wall 25*c*, and the cartridge 10 is mounted on the holder 20. Specifically, the cartridge 10 is moved vertically downward shown by arrow Zw while inserting the protrusion portion 160 into the guide groove 200*t*. At this time, since the width Wa of the upper end of the guide groove 200*t* is greater than the width Wt of the protrusion portion 160 of the cartridge 10, the protrusion portion 160 can be easily inserted into the guide groove 200*t*.

As shown in FIG. 9B, when the protrusion portion 160 of the cartridge 10 is moved to a position adjacent the deformation portion 212 and external force is applied by protrusion portion 160, the deformation portion 212 is elastically deformed outward (in the direction of the negative X axis direction). In this manner, the deformation portion 212 is elastically deformed, such that the cartridge 10 can be smoothly mounted on the holder 20.

Figure 10A:
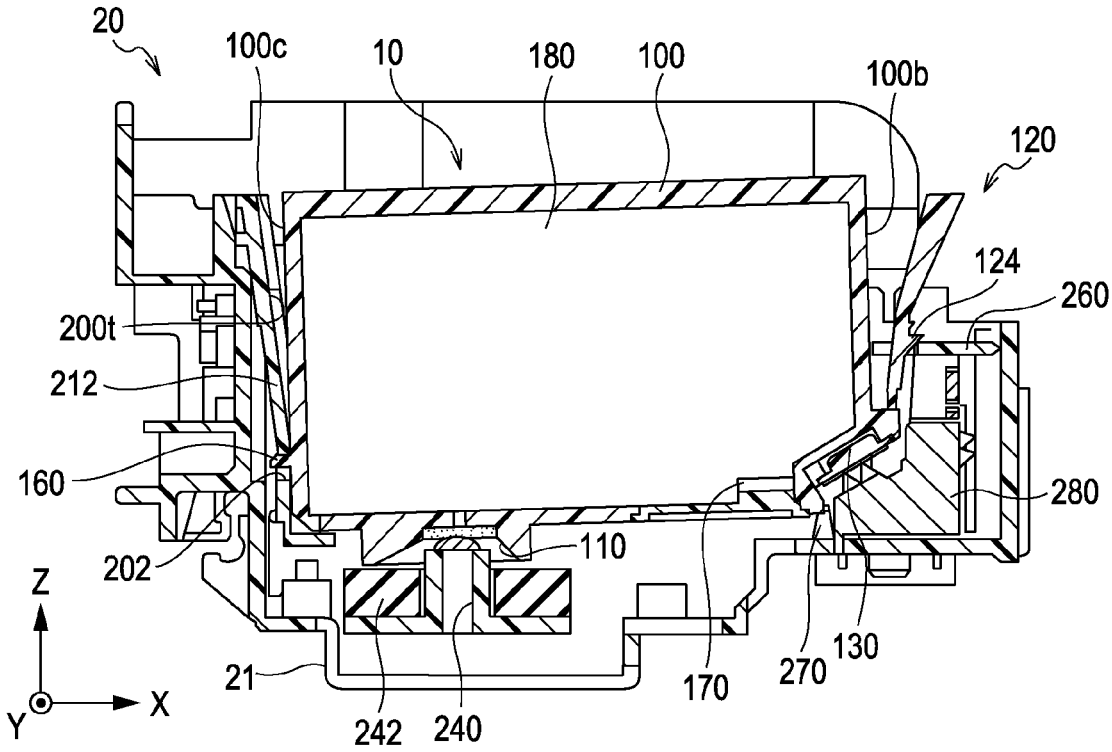
FIGS. 10A and 10B are cross-sectional side views showing the conditions of attaching an exemplary cartridge.
Figure 10B:
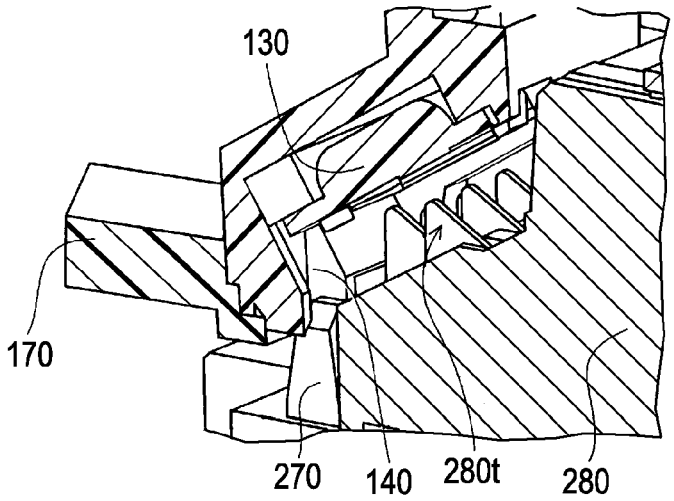

FIGS. 10A and 10B are additional views depicting attachment of the cartridge to the holder. Similar to FIGS. 9A and 9B, FIG. 10A shows a cross sectional view taken from lines XA-XA of the cartridge 10 of FIG. 3B and a cross-sectional view of holder 20 corresponding to the cross sectional view taken from lines XA-XA. Furthermore, FIG. 10B is a perspective view near the restriction pin 270 of FIG. 10A.

As shown in FIG. 10A, when the cartridge 10 is further moved vertically downward, the protrusion portion 160 is guided to the guide groove 200*t* and is inserted into the hole portion 202. In this state, the container side engagement portion 124 of the cartridge 10 is not engaged with the apparatus side engagement portion 260 of the holder 20.

When the protrusion portion 160 is inserted into the hole portion 202, as shown in FIG. 10B, the restriction pin 270 of the holder 20 is inserted into the notch 140 of the cartridge 10. By pushing down the second wall 100*b* side vertically downward in this state, the container side engagement portion 124 is engaged with the apparatus side engagement portion 260. During push-down operation, since the movement of the second wall 100*b* with the circuit board 130 attached thereto in the width direction is restricted, it is possible to accurately perform the positioning of the cartridge 10 relative to the holder 20. That is, it is possible to reduce the possibility of the respective terminals 130*a* to 130*i* (FIGS. 5A and 5B) of the circuit board 130 of the cartridge 10 after the mounting not coming into contact with the apparatus side terminal 280*t* (although there are nine terminals, it is collectively referred to as apparatus side terminal 280*t*) of the contact mechanism 280. Furthermore, since the notch 140 is provided in a position closer to the first wall 100*a* than the circuit board 130, when mounting the cartridge 10 on the holder 20, the restriction pin 270 is inserted into the notch 140 of the cartridge 10 before the respective terminals 130*a* to 130*i* of the circuit board 130 come into contact with the apparatus side terminal 280*t* of the contact mechanism 280, that is, in the state in which the restriction pin 270 is inserted into the notch 140 and the movement of the cartridge 10 in the width direction (the Y axis direction) is restricted to some degree, the respective terminals 130*a* to 130*i* of the circuit board 130. Thus, it is possible to more reliably cause the respective terminals 130*a* to 130*i* to come into contact with the contact mechanism 280 upon mounting the cartridge 10 on holder 20.

As mentioned above, since the guide groove 200*t* is formed in the apparatus side opposed wall 25*c*, the protrusion portion 160 can be more easily guided to the hole portion 202. In particular, since the guide groove 200*t* has the lower guide groove 200*tu*, the protrusion portion 160 can be more smoothly guided to the hole portion 202.

Figure 11A:
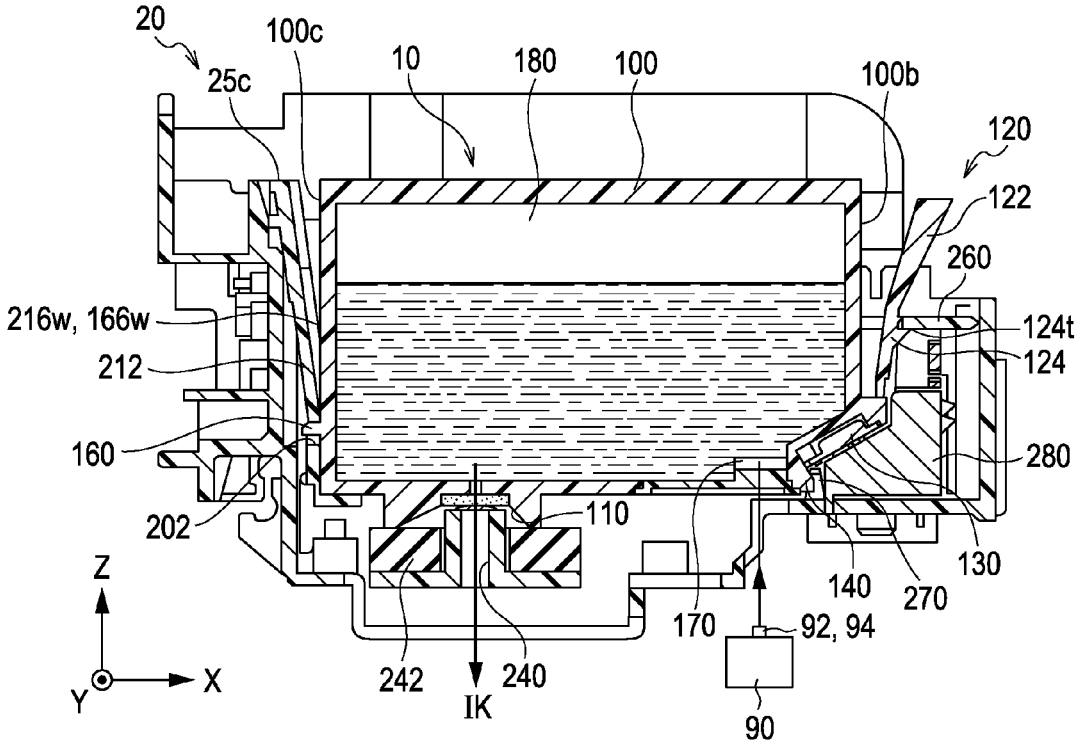
FIGS. 11A and 11B show a cross-sectional side view and perspective view of an exemplary cartridge after mounting.
Figure 11B:
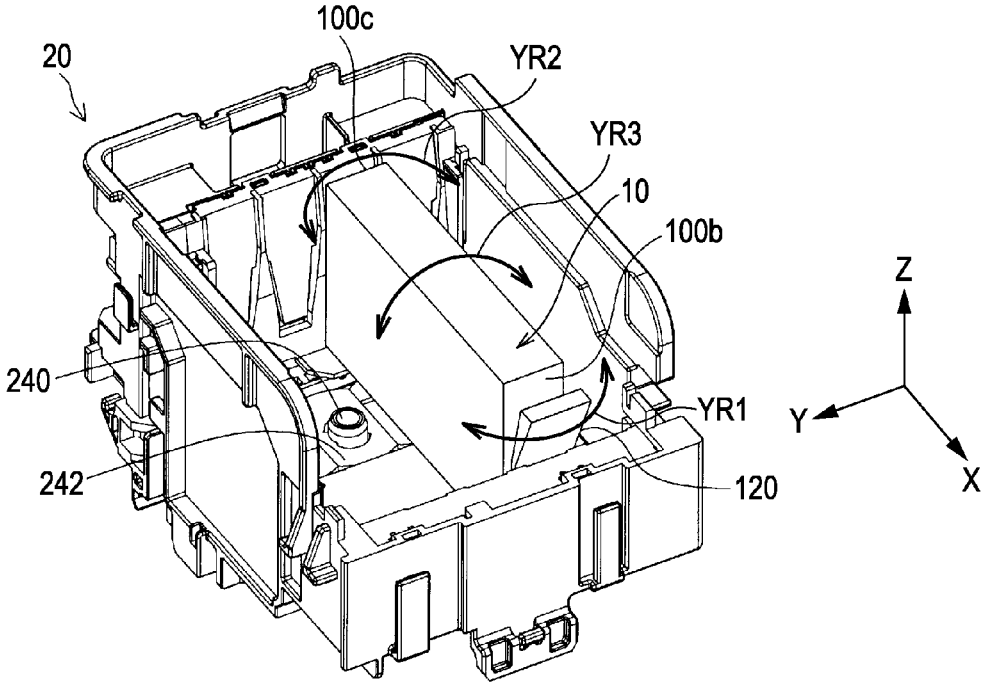

FIGS. 11A and 11B are drawing illustrating the state of the cartridge after mounting in the holder. Similar to FIGS. 9A and 9B, FIG. 11A shows a cross-sectional view taken from lines XIA-XIA of the cartridge 10 of FIG. 3B and a cross-sectional view of holder 20 taken from lines XIA-XIA. FIG. 11B is a perspective view of the mounting state (the mounting posture). FIG. 11A shows ink in the liquid accommodation chamber 180 illustrated by dots.

As shown in FIG. 11A, in the mounting state, the container side engagement portion 124 is engaged with the apparatus side engagement portion 260 such that the movement of the cartridge 10 in the height direction is restricted. In regard to the vertical direction (along the Z axis) in the usage posture of the holder 20 (the printer 1), the rotation fulcrum 216*w* is situated below the engagement point 124*t*. In the mounting state, the lever 120 is engaged with the apparatus side engagement portion 260 in the state closer to the second wall 100*b* than a non-load state. Thus, the lever 120 presses the container main body 100 against the apparatus side opposed wall 25*c* side so that movement of the cartridge 10 in the length direction (along the X axis) is restricted. In the mounting state, the liquid supply pipe 240 is connected to the liquid supply port 110, and each terminal of the circuit board 130 comes into contact with the respective corresponding electric contact members 280*a* to 280*i* of the contact mechanism 280. Through the circuit board 130, various information such as ink color or remaining quantity information of ink is transmitted between the cartridge 10 and the control unit 60 (FIG. 1) of the printer 1. In the mounting state, ink is supplied to the print head 21 via the liquid supply port 110 and the liquid supply pipe 240 by the absorption from the print head 21. To detect the quantity of ink remaining within the chamber, the optical detection device 90 is used at a predetermined timing.

In the mounting state, the restriction pin 270 cooperates with the notch 140 to restrict the movement of the second wall 100*b* side in the width direction. The hole portion 202 cooperates with the protrusion portion 160 to restrict the movement of the third wall 100*c* side in the width direction (the Y axis direction) and the height direction (the Z axis direction). The apparatus side engagement portion 260 cooperates with the container side engagement portion 124 to restrict the movement of the second wall 100*b* side in the height direction. The restriction of the movement of the second wall 100*b* side in the width direction due to the cooperation of the restriction pin 270 with the notch 140 is not premised on other restrictions.

Upon performing printing, the holder 20 and the cartridge 10 are moved in the main scanning direction (in the Y axis direction along the width direction of the cartridge 10). That is, the cartridge 10 is subjected to an external force (inertial force) in the width direction, as shown in FIG. 11B. The cartridge 10 is rotated in the rotation direction including the width direction component around the liquid supply port 110 (FIG. 11A). Specifically, the second wall 100*b* side portion is rotated in a direction of an arrow YR1, and the third wall 100*c* side portion is rotated in a direction of an arrow YR2. There is also a possibility that the cartridge 10 is rotated in a direction of an arrow YR3 by being subjected to the external force. The directions of the arrow YR1 and the arrow YR2 are rotational directions including the rotation in the Y direction (the width direction) about the Z axis, and the arrow YR3 is a rotation direction including rotation in the Y direction (the width direction) about the X axis. Herein, the circuit board 130 is provided in the second wall 100*b*. Thus, by providing the notch 140 for restricting the movement of the width direction in the second wall 100*b*, it is possible to further suppress movement (the deviation) of the circuit board 130 relative to the holder 20, as compared to a case of providing the notch 140 in the first wall 100*a*. As a result, it is possible to satisfactorily maintain the electric connection between the circuit board 130 (specifically, the terminal group 130*t*) and the printer 1 after the mounting. In the present embodiment, as mentioned above, the circuit board 130 is placed so as to partially overlap with the notch 140 in regard to the length direction (FIG. 3A). This aspect suppresses or minimizes movement (the deviation) of the circuit board 130 (including the terminal group 130*t*) relative to the holder 20. In addition, it is desirable that the notch 140 be provided so as to overlap with a part of the terminal group 130*t* included in the circuit board 130 in regard to the length direction (the X axis direction). In this manner, it is possible to further suppress and minimize movement (the deviation) of the terminal group 130*t* relative to the holder 20.

Herein, the inertial force caused by the movement in the main scanning direction was described as the external force of the width direction received by the cartridge 10, the external force received by the cartridge 10 is not limited thereto. For example, in a type referred to as an off-carriage printer in which only the print head is moved in the main scanning direction and the cartridge 10 is not moved in the main scanning direction, in some cases, the cartridge 10 is also subjected to the external force in the width direction. Specifically, in the off-carriage type printer, in some cases, the cartridge 10 is subjected to the vibration or the like generated from the movement of the print head in the main scanning direction or the like, and external force (inertial force) acts in the width direction of the cartridge 10.

Furthermore, in the case of providing the groove for restricting the movement of the width direction in the first wall 100*a* (the bottom surface), there is a need for a member for forming (defining) the groove. In the present embodiment, since the notch 140 restricting the movement in the width direction of the second wall 100*b* is provided, the size of the cartridge 10 in the length direction (along the X axis) can be reduced. Furthermore, notch 140 is provided in the corner portion of the first wall 100*b* side of the second wall portion 100*b* and opens in the direction of the negative Z axis (the first direction) and the X axis positive direction (the second direction) perpendicular to the Z axis negative direction (FIGS. 3A to 3D), thereby allowing the number of walls defining the notch 140 to be reduced when compared to a case where only an opening for receiving the first apparatus side restriction portion 270 of the holder 20 is formed. Thus, when mounting the cartridge 10 on the holder 20, it is possible to reduce the possibility of the wall defining the notch 140 interfering (colliding) with the first apparatus side restriction portion 270. As a result, it is possible to raise a degree of freedom or range of acceptable insertion angles of the cartridge 10 to the holder 20 when mounting the cartridge 10 on the holder 20, thereby improving ease of use during attachment.

Furthermore, the notch 140 can suppress the movement of the prism 170 in the width direction when engaged with the restriction pin 270. Particularly, in the present embodiment, the prism 170 is placed in contact with the inner surface of the second wall 100*b* formed with the notch 140 (FIG. 4A). As a result, it is possible to suppress the movement (the deviation) of the prism 170 in the width direction to the minimum to allow for more accurate determination of the remaining quantity of ink. Also, this placement reduces the possibility of interference of the flow of ink toward the liquid supply port 110 by the prism 170, thereby allowing for more effective consumption of ink within the liquid accommodation chamber 180 by reducing the remaining quantity of unused ink.

By forming the first restriction portion as the notch 140, it is possible to reduce the possibility of the first restriction portion (the notch 140) interfering with the holder 20 upon attaching or detaching the cartridge 10 to or from the holder 20, as compared to a case of forming the first restriction portion as a protrusion shape (in this case, the first apparatus side restriction portion 270 enters a concave state). As result, it is possible to suppress an occurrence of the disadvantage of the cartridge 10 or the holder 20 being damaged or the like.

In this manner, since the cartridge 10 has the notch 140 for restricting the movement of the width direction in the second wall 100*b* with the circuit board 130 mounted thereon, the deviation of the circuit board 130 relative to the holder 20 can be suppressed. Thus, it is possible to reduce the possibility of the electric connection between the circuit board 130 and the printer 1 being blocked. Since the deviation of the circuit board 130 relative to the holder 20 can be suppressed, a plurality of terminals can be provided by the circuit board 130. As a result, it is possible to perform the transmission of more information between the circuit board 130 and the printer 1.

A-5. Detachment of Cartridge

Figure 12A:
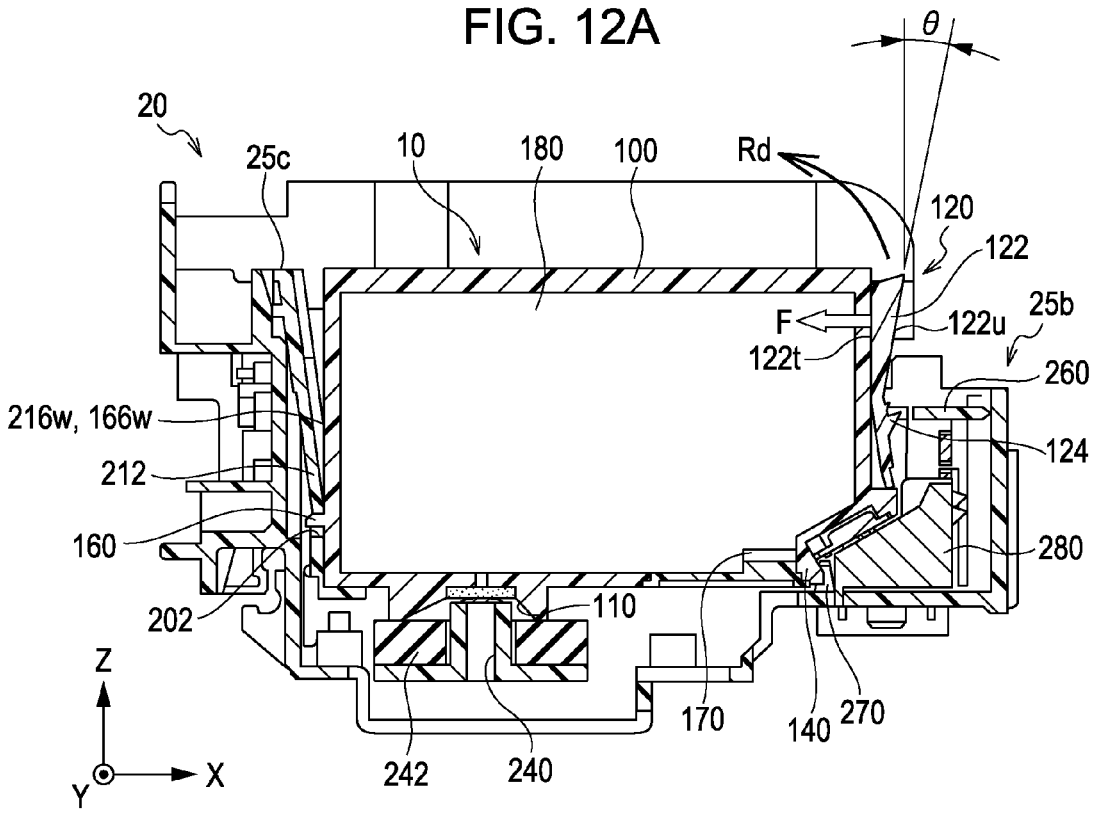
FIGS. 12A and 12B are cross-sectional views depicting detaching of an exemplary cartridge.
Figure 12B:
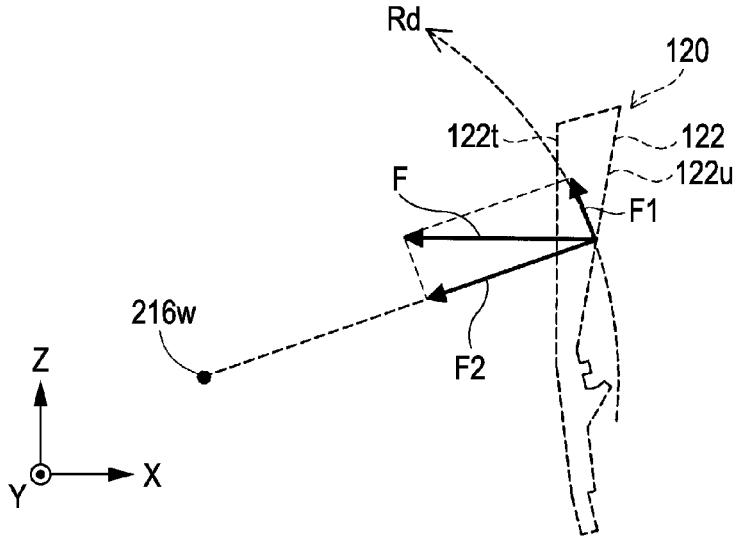

FIGS. 12A and 12B are drawings depicting detachment of the cartridge 10 is detached from the holder 20. FIG. 12A shows the detaching situation, and FIG. 12B shows a detail of one of the effects of detachment. FIG. 12A is a cross-sectional view taken from lines XIIA-XIIA of the cartridge 10 of FIG.

3B and a cross-section of the holder 20 corresponding to the cross-sectional view taken from lines XIIA-XIIA.

As shown in FIG. 12A, when detaching the cartridge 10 from the holder 20, the engagement release portion 122 is elastically deformed in a direction (the X axis negative direction, a direction in which the engagement is released) approaching (pressing) the container main body 100 (specifically, the second wall 100*b*). The engagement between the apparatus side engagement portion 260 and the container side engagement portion 124 is then released. In other words, the engagement is released by applying the external force to the engagement release portion 122 in a direction (the X axis negative direction) from the apparatus side engagement wall 25*b* toward the apparatus side opposed wall 25*c*. The engagement release portion 122 is formed so that the second side surface 122*u* is tilted by a predetermined angle θ from the vertical direction when the first side surface 122*t* comes into contact with the second wall 100*b*. The engagement release portion 122 is formed such that applying the external force F to the engagement release portion 122 in the direction of the negative X axis releases engagement allowing the cartridge 10 to be effectively detached from the holder 20. This reasoning will also be described using FIG. 12B.

As shown in FIG. 12B, a case will be considered where the external force F is applied to the engagement release portion 122 in a direction (the X axis negative direction) in which the engagement release portion 122 approaches the container main body 100 (specifically, the second wall 100*b*) so as to release the engagement. The external force F can be resolved into force F1 of the tangential direction component of circumference around the rotation fulcrum 216*w* and a radial direction component F2. When the second side surface 122*u* is tilted (inclined downward) so as to be close to the rotation fulcrum 216*w* as the second side surface 122*u* goes from the upper end to the lower end, the force F1 of the tangential direction component can be effectively transmitted to the engagement release portion 122. Thus, in the case of applying the external force to the engagement release portion 122 in a direction (the negative X axis direction) in which the engagement between the container side engagement portion 124 and the apparatus side engagement portion 260 is released, the engagement is released, and it is possible to easily rotate the cartridge 10 in a direction (the arrow Rd) in which the cartridge 10 is detached.

Figure 13A:
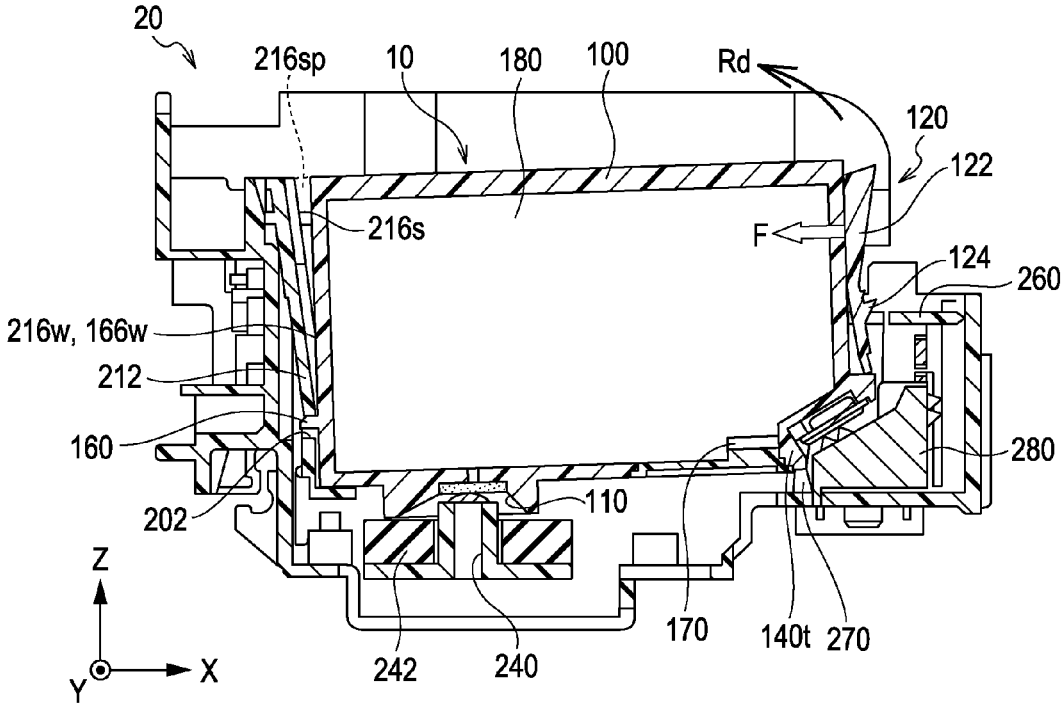
FIGS. 13A and 13B are cross-sectional side views depicting detaching of the exemplary cartridge.
Figure 13B:
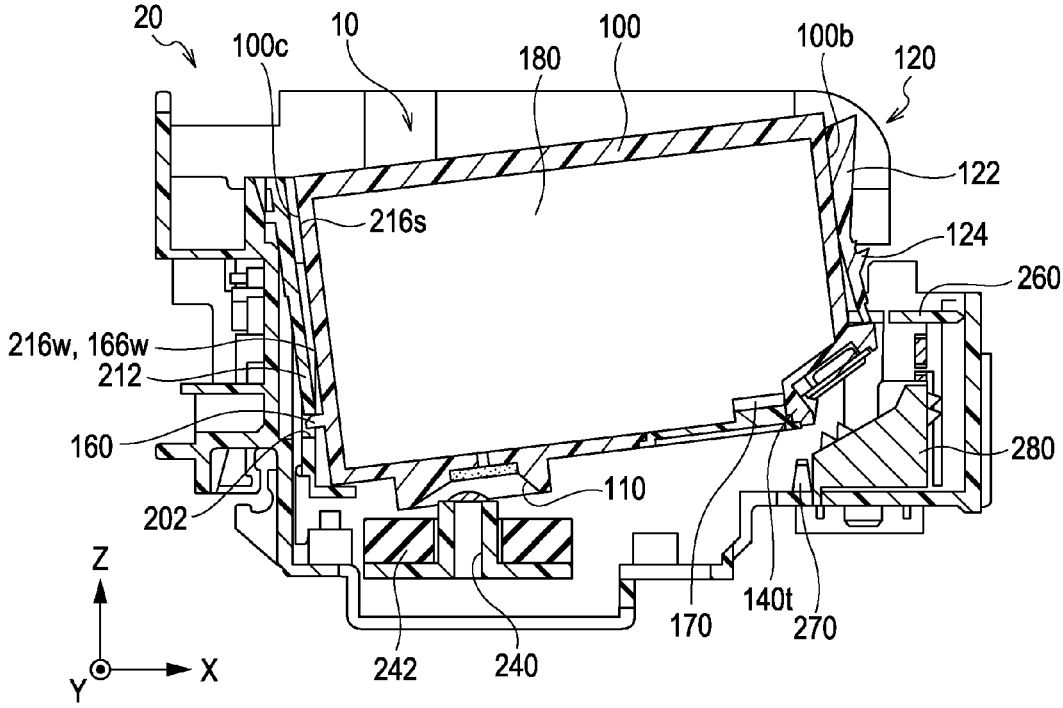

FIGS. 13A and 13B show the situation in which the cartridge 10 is detached from the holder 20. FIG. 13A shows the situation in which the cartridge 10 is rotated by the use of the rotation fulcrum 126*w* as a fulcrum. FIG. 13B shows the situation in which the cartridge 10 is rotated by the use of the rotation fulcrum 216*w* as a fulcrum. In addition, FIGS. 13A and 13B show the cross-sectional view taken from lines XIII-XIII of the cartridge 10 of FIG. 3B and the cross-section of the holder 20 corresponding to the cross-sectional view taken from lines XIII-XIII.

As shown in FIG. 13A, when the external force F of a predetermined direction component (the X axis negative direction component) is applied to the engagement release portion 122, the cartridge 10 is subjected to a rotation movement using the rotation fulcrum 216*w* as a fulcrum in the arrow Rd direction, which includes an upward component. Since the space portion 216*sp* is situated above the rotation fulcrum 216*w*, the rotational movement of the cartridge 10 in a predetermined direction is not inhibited by the holder 20.

As shown in FIG. 13B, when the rotation movement of the predetermined direction progresses, the third wall 100*c* of the cartridge 10 comes into contact with the upper surface 216*s*. In this state, the upper surface 216*s* becomes a barrier, whereby the rotation direction of a predetermined direction is inhibited. However, in this state, the second wall 100*b* side is lifted vertically upward in relation to the holder 20, to the extent that a user can easily pick up the second wall 100*b* side of the cartridge 10.

As mentioned above, the cartridge 10 is configured so that the rotation fulcrum 166*w* is situated below the engagement point 124*t* and the engagement release portion 122 is situated over the engagement point 124*t* (FIG. 11A). As shown in FIG. 12A, by applying the external force to the engagement release portion 122 in a predetermined direction (the X axis negative direction), it is possible to easily detach the cartridge 10 from the holder 20 by use of the rotation fulcrum 216*w*. That is, it is possible to perform an operation of releasing the engagement between the container side engagement portion 124 with the apparatus side engagement portion 260 and an operation of detaching the cartridge 10 from the holder 20 by a series of operations (FIGS. 12A to 13B), thereby providing a user with a holder 20 and ink cartridge 10 having improved operability of attachment. Furthermore, the rotation fulcrum 216*w* of the holder 20 can be easily defined by the opposed surface 216*u* and the extension surface 216*t* of the apparatus side opposed wall 25*c*.

A-6. Attachment of Cartridge by Another Method

Figure 14A:
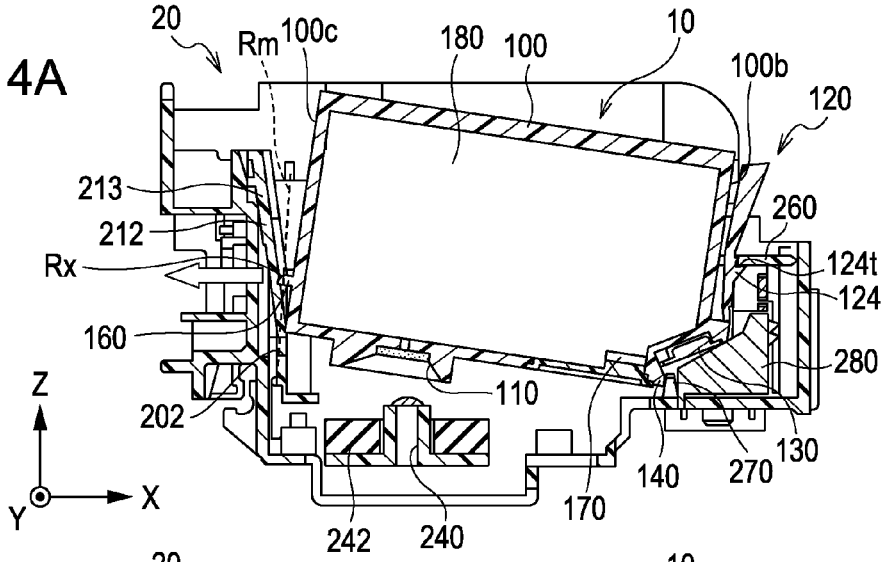
FIGS. 14A to 14C are cross-sectional side views depicting an alternative mounting method.
Figure 14B:
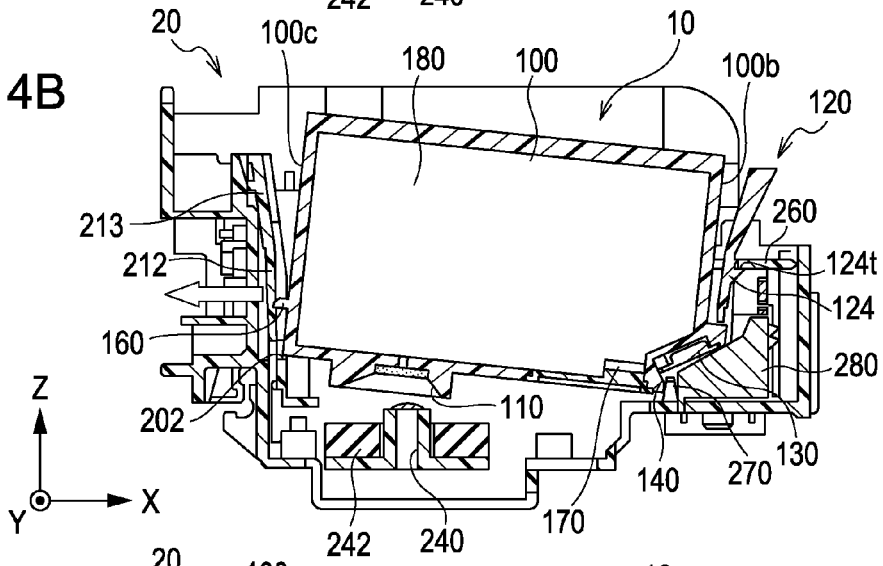
Figure 14C:
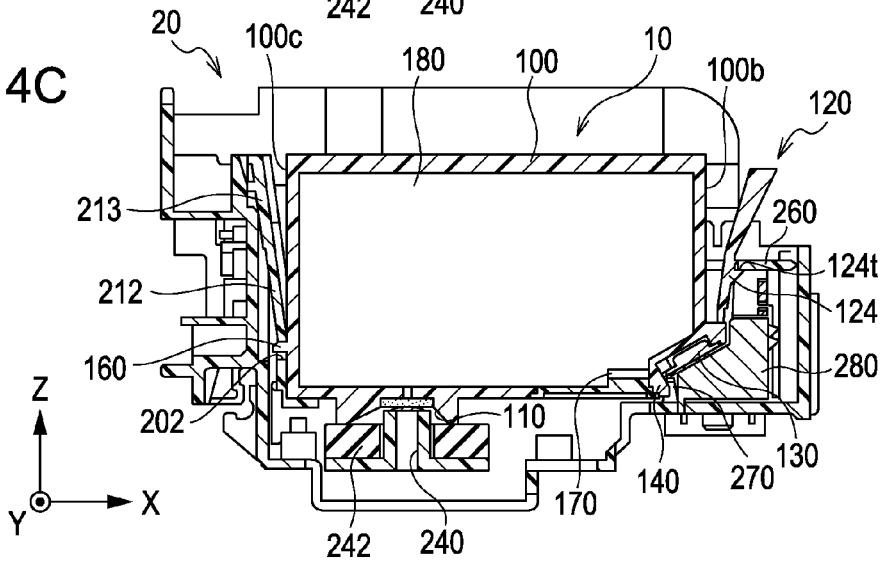

FIGS. 14A to 14C are cross-sectional views depicting an alternative mounting method. Time series are shown in the order of FIGS. 14A to 14C. Furthermore, FIGS. 14A to 14C are diagrams that show the cross-sectional view taken from lines XIV-XIV of the cartridge 10 of FIG. 3B and the cross-section of the holder 20 corresponding to the cross-sectional view taken from lines XIV-XIV. A mounting method (an engagement mounting method) of inclining the cartridge 10 so that the second wall 100*b* becomes the vertical portion lower than the third wall 100*c* when inserting the cartridge 10 into the holder 20 will be described using FIGS. 14A to 14C.

As shown in FIG. 14A, in the engagement mounting method, before the protrusion portion 160 is inserted into the hole portion 202, the container side engagement portion 124 is engaged with the apparatus side engagement portion 260. In this case, by rotating the cartridge 10 using the engagement point 124*t* as the rotation fulcrum, the cartridge 10 is mounted on the holder 20. At this time, the protrusion portion 160 draws a rotation trace Rm. The rotation trace Rm intersects the deformation portion 212, the deformation portion 212 situated at a point where the Rm intersects holder 20. In the usage posture, the deformation portion 212 is formed so as to reach a position higher than the intersection point Rx where the rotation trace Rm intersects the groove bottom wall 213. As shown in FIG. 14A, immediately after the protrusion portion 160 comes into contact with the groove bottom wall 213, the protrusion portion 160 abuts against the deformation portion 212.

As shown in FIG. 14B, when the third wall 100*c* side is pushed down vertically downward, the deformation portion 212 is pushed to the outside direction (in the direction of the negative X axis) of the holder 20 by the protrusion portion 160 and is elastically deformed. Due to the elastic deformation of the deformation portion 212, the third wall 100*c* side can be pushed down vertically downward so that the movement of the cartridge 10 is not limited. As a result, as shown in FIG. 14C, the cartridge 10 can be mounted on the holder 20.

Figure 15A:
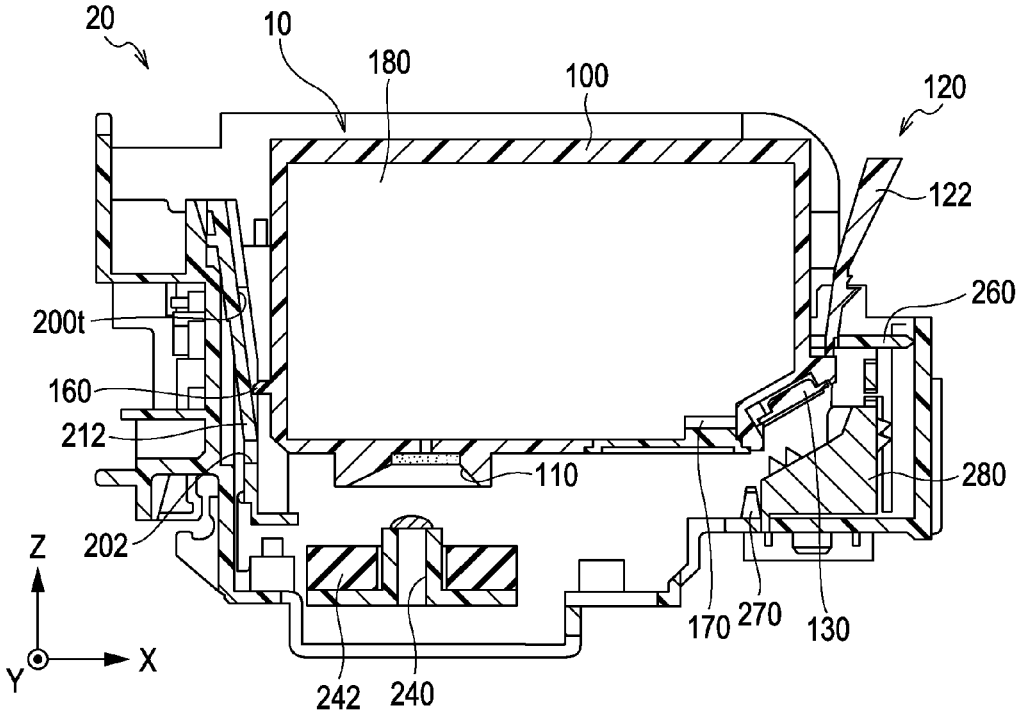
FIGS. 15A and 15B are cross-sectional side views depicting an alternative mounting method.
Figure 15B:
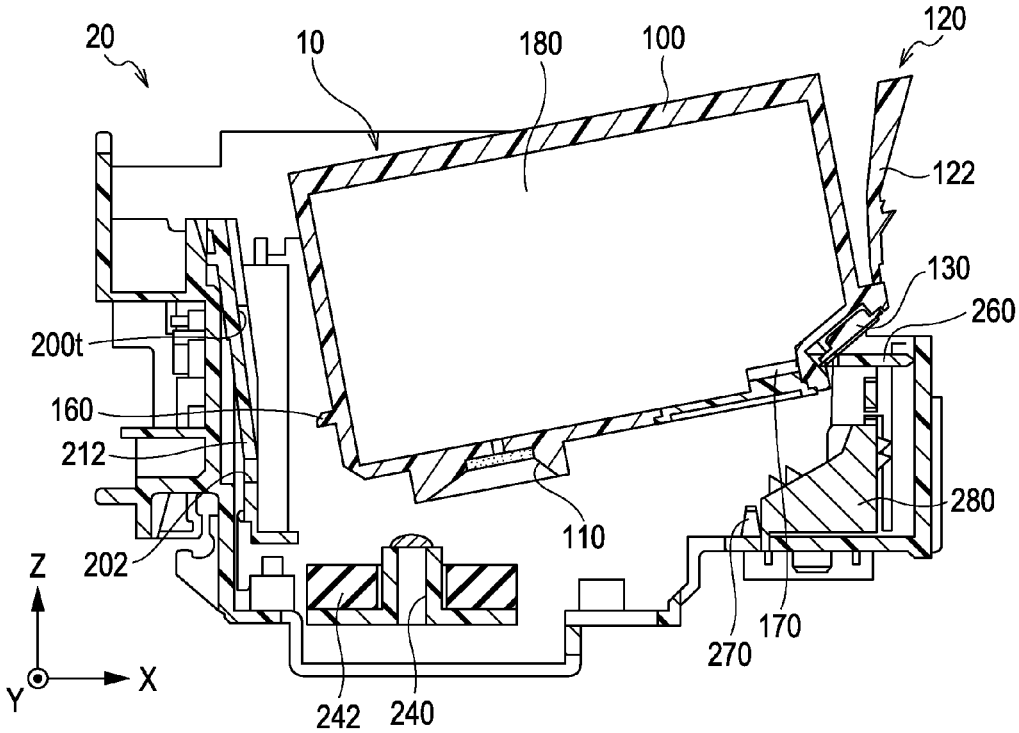

FIGS. 15A and 15B depict an alternative method of mounting a cartridge 10 to a holder 20. FIGS. 15A and 15B show cross-sectional views taken from lines XV-XV of the cartridge 10 of FIG. 3B and from lines XV-XV of the holder 20, respectively.

FIG. 15A shows a mounting method (an upward access mounting method) of mounting the cartridge 10 on the holder inserted immediately over the holder 20 without inclining the cartridge 10. Even in such a mounting method, since the deformation portion 212 can be elastically deformed, the holder 20 can be mounted on the cartridge 10 so that the movement of the cartridge 10 is not limited.

FIG. 15B shows a mounting method (a front access mounting method) of mounting the cartridge 10 on the holder 20 without inserting the protrusion portion 160 into the guide groove 200*t*. In the present embodiment, since the deformation portion 212 of holder 20 reduces the possibility of the movement of the cartridge 10 being limited and not being able to be mounted to the holder 20, there is no need to provide a member for preventing the mounting by a specific mounting method (a mounting method in which the movement is limited) in the opening of the holder 20.

As mentioned above, since the holder 20 has deformation portion 212, the movement of the cartridge 10 can be limited within the holder 20 before the cartridge 10 is mounted on the holder 20. As a result, since there is no need to provide a mechanism preventing a specific mounting method in the opening of the holder 20 thereby improving operability in attaching the cartridge 10 to the holder 20 while promoting a reduction in the number of components of the holder 20 and still allowing use of different mounting methods.

B. Second Embodiment

Figure 16A:
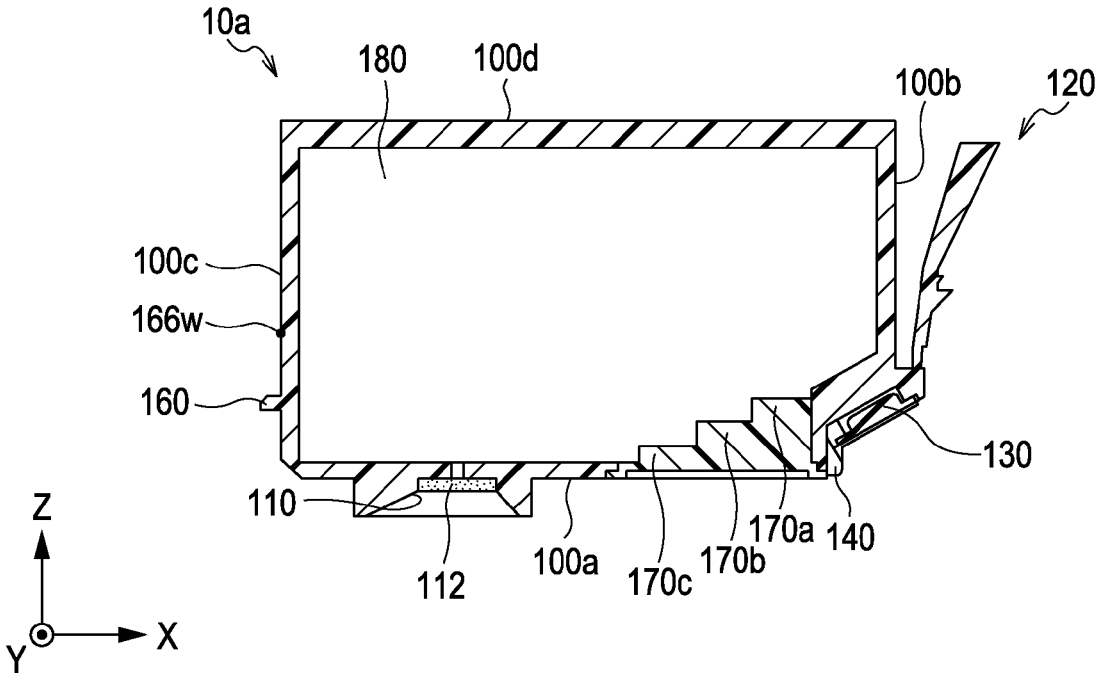
FIGS. 16A and 16B show another exemplary cartridge.
Figure 16B:
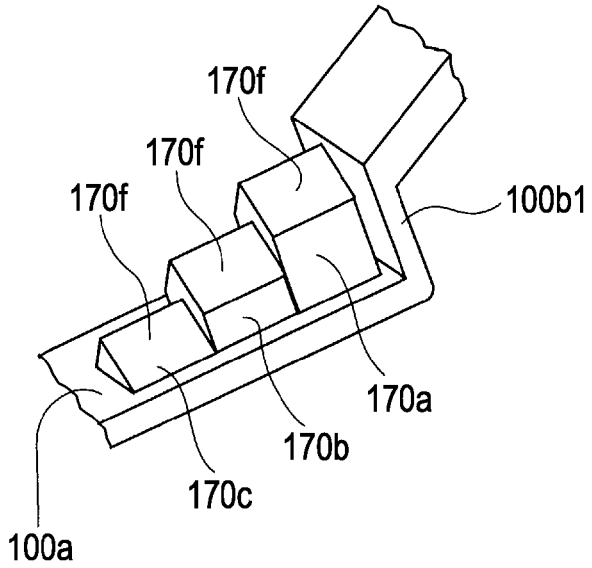
Figure 17A:
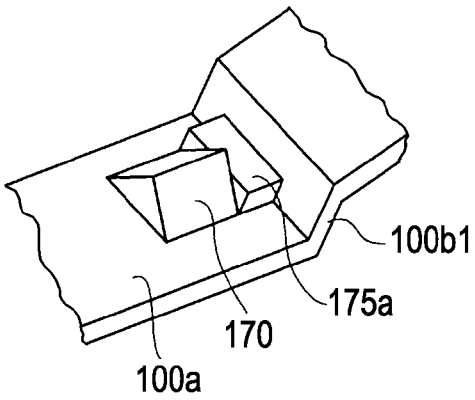
FIGS. 17A to 17E show details of alternative embodiments.
Figure 17B:
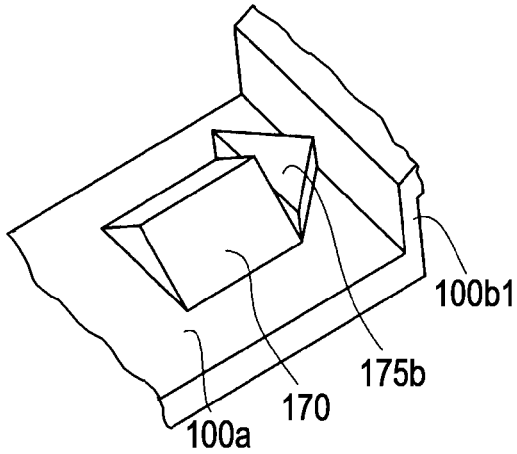
Figure 17C:
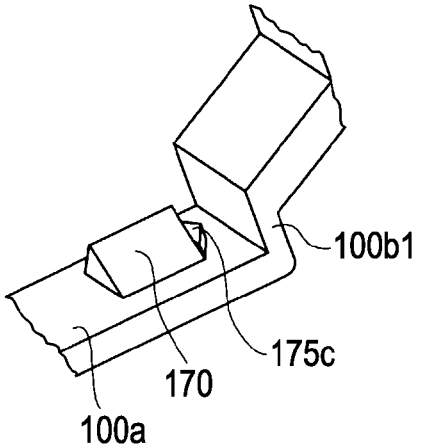
Figure 17D:
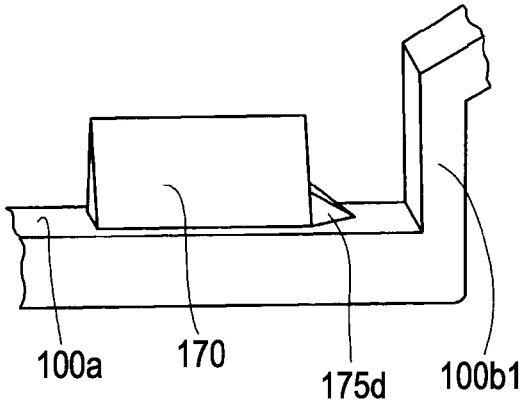
Figure 17E:
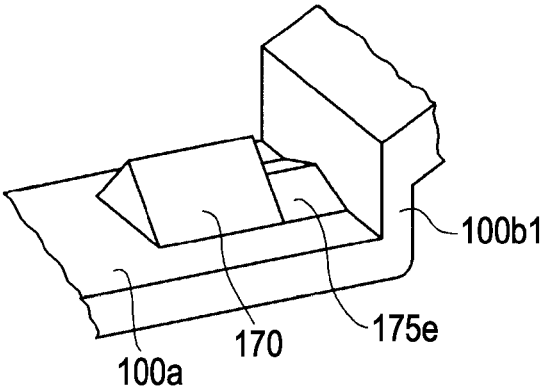

FIGS. 16A and 16B show a cartridge 10*a* of an alternative embodiment. FIG. 16A is a cross-sectional view of a cartridge 10*c* from lines XVIA-XVIA of FIG. 3B, and FIG. 16B shows prisms 170*a* to 170*c* of cartridge 10*a*. In addition, the second embodiment is different from the first embodiment in the configurations of the prisms 170*a* to 170*c*, and other configurations are the same as those of the first embodiment. Thus, the same configurations are denoted by the same reference numerals and the descriptions thereof will be omitted. Furthermore, the configuration of the holder 20 to be mounted with the cartridge 10*a* and the configuration of the printer 1 are the same as those of the first embodiment.

As shown in FIG. 16A, first, second and third prisms 170*a* to 170*c* are provided in the first wall 100*a*. The respective prisms 170*a* to 170*c* include portions of right angle isosceles triangular prism shapes including the reflection surface 170*f*. Furthermore, distances between the reflection surfaces of the respective prisms 170*a* to 170*c* and the first wall 100*a* are different from each other, respectively. In an exemplary embodiment, the distance between the reflection surface and the first wall 100*a* is a length of the prism positioned closest the notch 140. Preferably, the prism having the greatest distance 170*a* is placed in contact with the inner surface of the second wall 100*b* provided with the notch 140, and the prisms are placed further from the second wall 100*b* in order of decreasing distance. In this manner, by arranging the first to third prisms 170*a* to 170*c*, a distance between the reflection surface 170*f* and an optical detection device (not shown) along the Z-axis becomes greater nearest notch 140. In addition, the optical detection device may be placed in the printer 1 so as to correspond to the number of the prism to detect the remaining quantity, and may be moved immediately under the respective prisms 170*a* to 170*c* to detect the remaining quantity.

In this manner, by arranging the plurality of prisms 170*a* to 170*c* having different heights of the reflection surface 170*f*, the remaining quantity of ink of the cartridge 10*a* can be more specifically detected. Furthermore, as the distance between the optical detection device and the reflection surface 170*f* becomes longer, the deviation of the relative positions between the reflection surface 170*f* and the optical detection device is generated, thereby the detection accuracy of the remaining quantity of ink tends to decrease. In the present embodiment, the prisms are placed so as to be closer to the notch 140 so that the deviation relative to the holder 20 can be further suppressed to the extent of the prism 170*a* in which the distance between the optical detection device and the reflection surface 170*f* is relatively large. Thus, it is possible to reduce the irregularity of the detection accuracy of the remaining quantity of ink using the respective prisms 170*a* to 170*c*. Also, since the cartridge 10*a* of the second embodiment has the notch 140 like the first embodiment, the cartridge 10*a* can cooperate with the restriction pin 270 of the holder 20 to restrict the movement in the width direction (the Y axis direction) so as to satisfactorily maintain the electrical connection between the circuit board 130 (specifically, the terminal group 130*t*) and the printer 1.

C. MODIFIED EXAMPLE

Elements other than those of the independent aspect of the claimed invention and embodiments described above are additional elements that can be suitably omitted. Additionally, the invention is not limited to the embodiments mentioned above but can be carried out in various forms without departing from the scope and spirit of the invention, such that additional modification, such as those presented below, are also possible.

C-1. First Modified Example

In the embodiments mentioned above, although the prisms 170 and 170*a* are placed in contact with the inner surface of the second wall 100*b* (FIG. 4A and FIG. 16A), the prisms 170 and 170*a* may be placed separately from the second wall 100*b* without being limited thereto. Even in such cases, the movement (the deviation) of the circuit board 130 relative to the holder 20 is suppressed and it is preferable to adopt the modified form as below. FIGS. 17A to 17E show modified forms of the first modified example depicting the vicinity of the prism 170. The first modified example is different from the first embodiment in that the prism 170 is disposed separately from the inner surface of the first vertical wall portion 100*b*1 and protrusion-like members 175*a* to 175*e* are provided between the prism 170 and the first vertical wall portion 100*b*1. Since other configurations are the same as those of the first embodiment, the same configurations are denoted by the same reference numerals and the descriptions thereof are omitted.

The protrusion-like members 175*a* to 175*e* are protrusions extending from the first wall 100*a* toward the inner portion of the liquid accommodation chamber 180, the shapes adopting a rectangular shape (FIG. 17A, reference numeral 175*a*), a triangular prism shape (FIGS. 17B to 17E, reference numerals 175*b* to 175*e*) or the like. In some embodiments, the protrusion-like members 175*a*, 175*b* and 175*e* are placed in contact with both the prism 170 and the first vertical wall portion 100*b*1. In this manner, by having the protrusion-like members 175*a* to 175*e*, it is possible to prevent ink being restrained by the prism 170 so that ink of the first vertical wall portion 100*b*1 side is guided to the liquid supply port 110 (FIG. 4A) so as to more effectively consume ink within the liquid accommodation chamber 180 (FIG. 4A).

C-2. Second Modified Example

In the embodiments mentioned above, although the cartridges 10 and 10*a* used the prisms 170, 170*a* to 170*c* to detect the remaining quantity of ink (FIG. 4A and FIG. 16A), such prisms can optionally be omitted. Instead of using prisms, the quantity of ink can be detected using a piezoelectric element or a sensor with an electrode. Even in such embodiments, the notches 140 of the cartridges 10 and 10*a* cooperate with the restriction pin 270 of the holder 20, to suppress undesired movement (the deviation) of the circuit board 130 relative to the holder 20. As in the embodiments mentioned above, operability of attaching or detaching the cartridges 10 and 10*a* to or from the holder 20 can be improved by the rotation fulcrum 166*w*, 216*w* or the deformation portion 212 of the holder 20.

C-3. Third Modified Example

In the embodiments mentioned above, although a notch 140 was used as the first restriction portions of the cartridges 10 and 10*a*, the shapes of the restriction portion are not so limited. For example, the protrusions as the first restriction portions may be provided in the second wall 100*b*. In this case, in the holder 20, a concave portion is provided into which the protrusion is inserted instead of the restriction pin 270. Even in such cases, since the movement of the cartridges 10 and 10*a* in the width direction is suppressed after mounting, the electric connection between the circuit board 130 and the printer 1 is satisfactorily maintained. Furthermore, although the notch 140 is described as being provided in approximate center of the width direction of the first vertical wall portion 100*b*1 (FIG. 3B), the invention is not so limited. For example, the notch 140 may be formed in one end of the width direction of the first vertical wall portion 100*b*1. That is, in the notch 140 of the embodiment mentioned above, both sides of the width direction may be formed by the first vertical wall portion 100*b*1, but only one side may be formed by the first vertical wall portion 100*b*1 while the other side is open, such that the notch may be open toward three directions. Even in such cases, it is possible to restrict the movement (the movement of any one side of the width direction) of the cartridges 10 and 10*a* in the mounting state, thereby suppressing the deviation of the circuit board 130 relative to the holder 20. Furthermore, like the embodiments mentioned above, it is possible to improve the operability upon attaching or detaching the cartridges 10 and 10*a* to or from the holder 20 by the rotation fulcrums 166*w* and 216*w* or the deformation portion 212 of the holder 20.

C-4. Fourth Modified Example

In the embodiments mentioned above, although the second wall 100*b* of the cartridges 10 and 10*a* has the shape having the first vertical wall portion 100*b*1, the inclined wall portion 100*b*2, and the second vertical wall portion 100*b*3, the shape of the cartridge 10 may adopt an arbitrary shape. For example, the shape may be an approximately rectangular shape not having the inclined wall portion 100*b*2 or a shape in which the second wall 100*b* is uniformly inclined. The respective walls 100*a* to 100*f* may be tilted at any angle, and an angle at which the respective walls 100*a* to 100*f* intersect with each other may be an angle other than 90°. That is, if the liquid accommodation chamber 180 can be formed in which ink can be accommodated in the inner portion thereof, the cartridges 10 and 10*a* can adopt any shape.

C-5. Fifth Modified Example

In the embodiments mentioned above, although the outer surface of the third wall 100*c* of the cartridges 10 and 10*a* used the rotation fulcrum 166*w* (FIG. 3A), the protrusion may be provided in the third wall 100*c* to use the protrusion as the rotation fulcrum 166*w*. Even in such cases, by rotating the cartridges 10 and 10*a* by the rotation fulcrum 166*w*, the cartridge 10 can be easily detached from the holder 20.

C-6. Sixth Modified Example

In the embodiments mentioned above, although the cartridges 10 and 10*a* use a protrusion portion 160, the protrusion portion can be omitted. The holder 20, the guide groove 200*t* and the hole portion 202 (FIGS. 7A and 7B) may also be omitted. Even in such cases, it is possible to improve the operability upon attaching or detaching the cartridges 10 and 10*a* to or from the holder 20 by the rotation fulcrums 166*w* and 216*w* or the deformation portion 212 of the holder 20.

C-7. Seventh Modified Example

In the embodiments mentioned above, although the guide groove 200*t* of the holder 20 had the tapered lower guide groove 200*tu*, the invention is not so limited. For example, the width of the guide groove 200*t* may be approximately uniform. Even in such cases, it is possible to easily guide the protrusion portion 160 up to the hole portion 202 of the holder 20 by the guide groove 200*t*.

C-8. Eight Modified Example

In the embodiments mentioned above, although the terminals of the circuit board 130 were constituted by two rows, the terminals may be constituted by one row and three rows or more. When the terminals are constituted by three rows or more, it is preferable that the first row closest to the first restriction portion (the notch) 140 include more terminals than those of the row farthest from the first restriction portion (the notch) 140. In this manner, it is possible to satisfactorily maintain the electric connection between each terminal included in the first and second rows and the printer 1. Furthermore, when the terminals are constituted by three rows or more, it is preferable that more terminals are positioned close to the first restriction portion (the notch) 140) so as to satisfactorily maintain the electric connection between each terminal of the circuit board 130 and the printer 1.

C-9. Ninth Modified Example

In the first embodiment, although the elastic portion (the lever) 120 was provided in the second wall 100*b* of the cartridge 10, the engagement release portion 122 may be provided on the holder 20 side while forming the container side engagement portion 124 in the second wall 100*b* of the cartridge 10. Even in such cases, the external force is applied to the engagement release portion 122 by a user so that engagement between the holder 20 and the container side engagement portion 124 can be released.

C-10. Tenth Modified Example

In the embodiments mentioned above, although the configuration was described in which the circuit board 130 (FIGS. 5A and 5B) including the terminal group 130*t* having nine terminals 130*a* to 130*i* and the storage portion 133 is attached to the container main body 100, a configuration may be adopted in which the terminal group 130*t* is directly provided in the container main body 100. Even in such a configuration, it is possible to suppress the movement (the deviation) of the terminal group 130*t* relative to the liquid ejecting apparatus (the printer 1) in the width direction, thereby satisfactorily maintaining the contact between the terminal group 130*t* and the liquid ejecting apparatus (the printer 1). In this case, it is more preferable that the notch 140 is provided in the container main body 100 so as to overlap a part of the terminal group 130*t* in regard to the length direction (the X axis direction). In this manner, it is possible to further suppress the movement (the deviation) of the terminal group 130*t* relative to the liquid ejecting apparatus (the printer 1) in the width direction.

C-11. Eleventh Modified Example

In the embodiments mentioned above, although the apparatus side opposed wall 25*c* of the holder 20 had the deformation portion 212 (FIG. 8), the deformation portion 212 may not be included. Even in this case, by having the rotation fulcrum 166*w* and 216*w*, it is possible to improve the operability upon attaching or detaching the cartridges 10 and 10*a* to or from the holder 20.

C-12. Twelfth Modified Example

The shapes of the cartridges 10 and 10*a* are not limited to the embodiments mentioned above, and various shapes can be adopted. FIGS. 29A and 29B are diagrams for describing a cartridge 10*d* of a twelfth modified example. FIG. 29A is a side view of the cartridge 10*d* in which the cartridge 10*d* is viewed from the fifth wall 100*e* side. FIG. 29B is a diagram for describing the wall of the cartridge 10*d*. As shown in FIG. 29A, the cartridge main body 100*df* of the cartridge 10*d* has a side surface of an oval shape or an oblong shape. The liquid accommodation chamber 180*f* also has a side surface of an overall shape or an oblong shape. Furthermore, the cartridge main body (the container main body) 100*df* is provided with the lever 120 and the circuit board 130 on the front side thereof. The liquid supply port 110 is formed on the bottom side of the cartridge 10*d*, and the protrusion 160 is formed on the bottom side thereof. In addition, when viewing the cartridge 10*d* from the front side (a side provided with the lever 120), the cartridge 10*d* has a uniform width like FIG. 3B. In addition, the liquid accommodation chamber 180*f* also has the uniform width.

A defining method of the wall of the cartridge 10*d* will be described hereinafter. As shown in FIG. 18B, the first wall 100*a* is a wall in the Z axis negative direction with respect to the liquid accommodation chamber 180*f*, and constitutes the bottom surface in the mounting posture. The second wall 100*b* is a wall in the X axis positive direction with respect to the liquid accommodation chamber 180*f*. The second wall 100*b* is connected to the first wall 100*a* and enters the erected state. The third wall 100*c* is a wall in the Z axis negative direction with respect to the liquid accommodation chamber 180*f*. The third wall 100*c* faces the second wall 100*b* with the liquid accommodation chamber 180*f* interposed therebetween. The fourth wall 100*d* is a wall in the Z axis positive direction side with respect to the liquid accommodation chamber 180*f* and constitutes the upper surface in the mounting posture. The fourth wall 100*d* faces the first wall 100*a* with the liquid accommodation chamber 180*f* interposed therebetween. The fifth wall 100*e* is a wall in the Y axis positive direction with respect to the liquid accommodation chamber 180*f*. The sixth wall 100*f* is a wall in the Y axis negative direction with respect to the liquid accommodation chamber 180*f*, and faces the fifth wall 100*e* with the liquid accommodation chamber 180*f* interposed therebetween. Herein, the notch (the groove) 140 is provided in the second wall 100*b* like the embodiments mentioned above. The notch 140 is formed on the outer surface of the second wall 100*b* as in the embodiments mentioned above. In addition, in order to facilitate understanding, the first to fourth walls 100*a* to 100*d* are illustrated with line hatching.

Herein, when the shape of the liquid accommodation chamber 180*f* or the shape of the cartridge 10*d* are complex, the wall can be defined by the method described below. That is, a hypothetical case 180*fg* is defined which is accommodated in the liquid accommodation chamber 180*f* and the hypothetical case 180*fg* has an approximately rectangular shape of the largest volume. Each wall 100*a* to 100*fw* can be defined depending on which side is situated on the basis of the hypothetical case 180*fg*. In addition, when the cartridge includes a plurality of liquid accommodation chambers, among the space portions of the approximately cubic body accommodating the plurality of liquid accommodation chambers, a minimum space portion having a minimum volume is defined. Moreover, the minimum space portion may be assumed to be a single liquid accommodation chamber to define the hypothetical case 180*fg*.

Figure 18A:
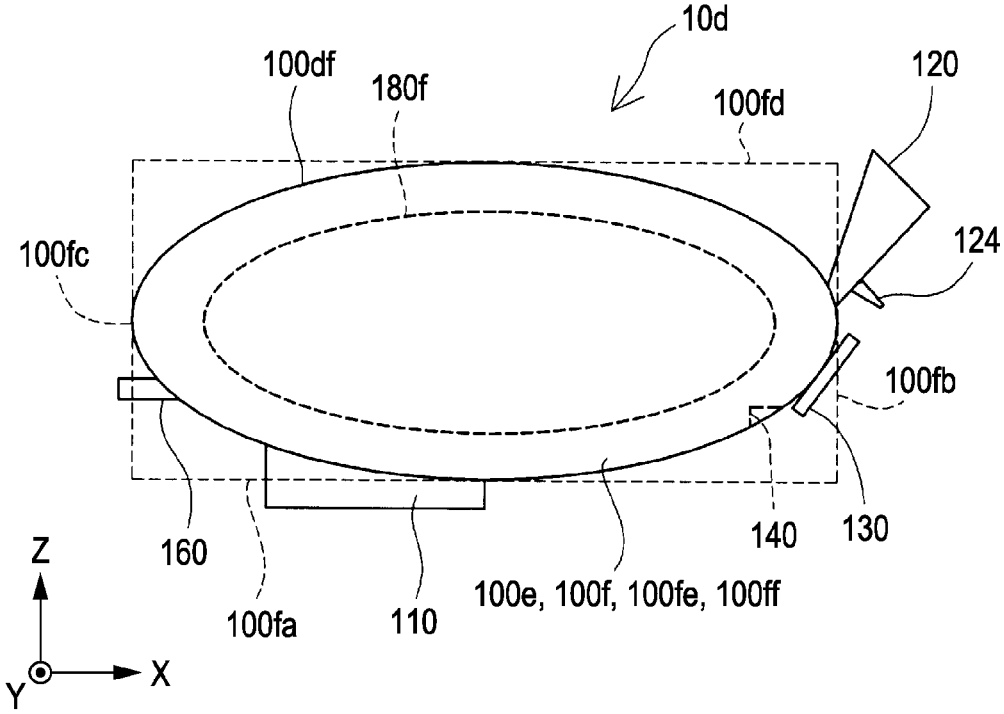
FIGS. 18A and 18B show another exemplary cartridge.
Figure 18B:
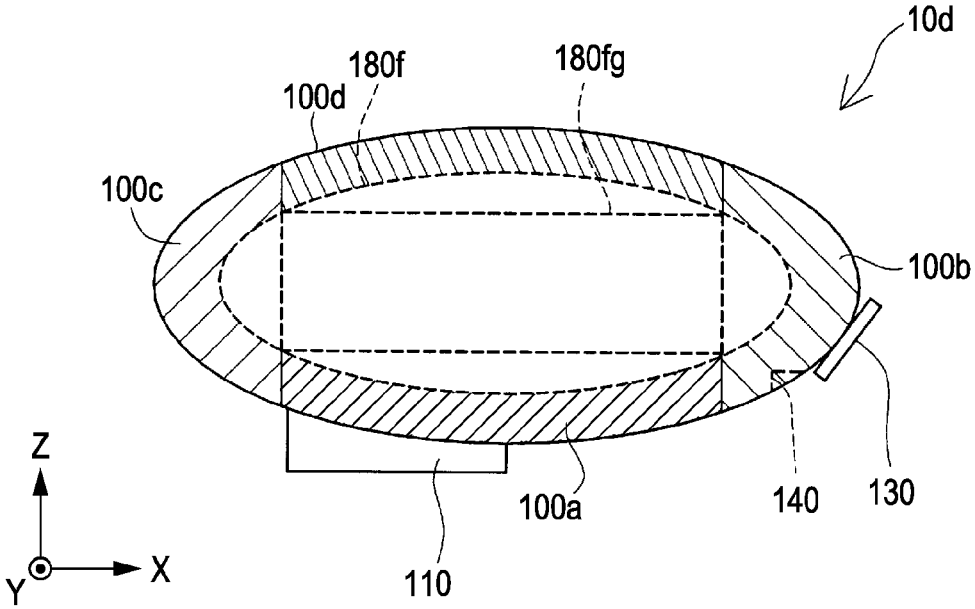

Furthermore, even when the shape of the cartridge is a shape other than the approximately cubic body, as shown by dashed lines in FIG. 18A, it is possible to hypothetically consider six surfaces of the approximately cubic body, that is, a bottom surface (a first surface) 100*fa*, a front surface (a second surface) 100*fb*, a rear surface (a third surface) 100*fc*, an upper surface (a fourth surface) 100*fd*, a left surface (a fifth surface) 100*fe*, and a right surface (a sixth surface) 100*ff*. Herein, the respective surfaces (the first to sixth surfaces) 100*fa* to 100*ff* correspond to the outer surfaces of the first to sixth walls 100*a* to 100*f* of FIGS. 3A to 3D. The six surfaces 100*fa* to 100*ff* of the approximately cubic body are surfaces that form the approximately cubic body of the minimum volume among the approximately cubic body accommodating the cartridge main body 100*df*. In the present description, "surfaces (plane)" can be used in the sense that includes both of the hypothetical surfaces (also called a non-existence plane) and the existence surface as shown in FIGS. 3A to 3D. Furthermore, the term "surfaces" is used in the sense that includes both the plane and the curved surface.

C-13. Thirteenth Modified Example

In the embodiments and the modified examples mentioned above, the cartridges 10 and 10*a* to be used in the printer 1 as the liquid accommodating container were described as an example. However, the invention can be applied to, for example, a liquid accommodating container that can supply liquid to an apparatus such as a liquid crystal display including a color material ejecting head, an apparatus such as an organic EL display and a face emission display (FED) including an electrode material (a conductive paste) ejecting head to be used in forming the electrode, an apparatus including a bio-organic ejecting head used in manufacturing a bio chip, an apparatus including a sample ejecting head as a precision pipette, and a liquid ejecting apparatus such as a printing apparatus or a micro-dispenser, without being limited thereto. Furthermore, the invention can be applied to a holder on which various liquid accommodating containers can be mounted in a freely attachable or detachable manner without being limited to the ink cartridge. When the liquid accommodating container is used in the various liquid ejecting apparatuses, liquid (the color material, the conductive paste, the bio-organic matter or the like) depending on the type of liquid to be ejected by the various liquid ejecting apparatuses may be accommodated in the inner portion of the liquid accommodating container. Furthermore, the invention can be applied as various liquid ejecting apparatuses including the holder, and a liquid ejecting system that includes the liquid accommodating containers corresponding to the various liquid ejecting apparatuses.

What is claimed is:

1. A liquid accommodating container adapted to be attached to or detached from a liquid ejecting apparatus, the liquid accommodating container comprising:

a first wall extending along an X-axis direction and provided on a negative side of a Z-axis direction orthogonal to the X-axis direction;

a second wall connected to the first wall at a positive side on the X-axis direction, the second wall having an inclined wall portion and a vertical wall portion connected to and intersecting with the inclined wall portion, the vertical wall portion extending along the Z-axis direction;

a third wall connected to the first wall at a negative side on the X-axis direction and extending along the Z-axis direction;

a liquid supply port provided on the first wall closer to the third wall than the second wall;

a terminal group provided on the inclined wall portion; and a notch provided in a portion of the second wall closer to the first wall than where the terminal group is provided, wherein the notch is adapted to receive a projection of the liquid ejecting apparatus, the notch opening toward the negative side of the Z-axis direction and the positive side of the X-axis direction.

2. The liquid accommodating container according to claim 1, wherein the notch is provided in the second wall so as to overlap with a part of the terminal group in regard to the X-axis direction.

3. The liquid accommodating container according to claim 1, the terminal group further comprising a plurality of terminals positioned so as to form a plurality of rows, wherein a first row of the plurality is in a position adjacent the notch and includes more terminals than a second row in a position further from the notch than the first row.

4. The liquid accommodating container according to claim 3, wherein the plurality of rows includes more terminals in rows which are positioned closer to the notch.

5. The liquid accommodating container according to claim 1, further comprising:

a prism extending from the first wall into a liquid accommodation chamber so as to optically detect an amount of a liquid accomodated within the liquid accommodation chamber, wherein the prism is provided between the liquid supply port and the second wall and has a reflection surface adapted to reflect a light irradiated from an optical detection apparatus outside the liquid accommodating container toward the optical detection apparatus, wherein a reflection state of the reflection surface changes depending on the refractive index of fluid in contact with the reflection surface.

6. The liquid accommodating container according to claim 5, wherein the prism is positioned in contact with an inner surface of the second wall.

7. The liquid accommodating container according to claim 5, wherein the liquid accommodating container includes two or more prisms, and a distance between the first wall and the reflection surface is sufficiently large so that a distance between the reflection surface and the optical detection apparatus is at least that of a length of the prism closest the notch.

8. The liquid accommodating container according to claim 5, wherein a portion of the prism that includes the reflection surface of the prism has a right angle isosceles triangular prism shape.

9. A liquid ejecting apparatus including the liquid accommodating container according to claim 1.

10. A liquid ejecting apparatus including the liquid accommodating container according to claim 2.

11. A liquid ejecting apparatus including the liquid accommodating container according to claim 3.

12. A liquid ejecting apparatus including the liquid accommodating container according to claim 4.

13. A liquid ejecting apparatus including the liquid accommodating container according to claim 5.

14. A liquid ejecting apparatus including the liquid accommodating container according to claim 6.

15. A liquid ejecting apparatus including the liquid accommodating container according to claim 7.

* * * * *